US005609077A

United States Patent [19]

Ohmi et al.

[11] Patent Number: 5,609,077

[45] Date of Patent: Mar. 11, 1997

[54] TIGHTENING DEVICE

[75] Inventors: Tadahiro Ohmi, Sendai; Nobukazu Ikeda, Osaka; Ryosuke Dohi, Osaka; Kunio Nagai, Osaka; Eiji Ideta, Osaka; Koji Nishino, Osaka; Michio Yamaji, Osaka; Tsutomu Shinohara, Osaka; Naofumi Yasumoto, Osaka, all of Japan

[73] Assignee: Fujikin Incorporated, Osaka, Japan

[21] Appl. No.: 697,031

[22] Filed: Aug. 20, 1996

Related U.S. Application Data

[63] Continuation of Ser. No. 253,738, Jun. 3, 1994, abandoned.

[30] Foreign Application Priority Data

Jun. 4, 1993 [JP] Japan ..... 5-134788

[51] Int. Cl.[6] ..... B25B 21/00

[52] U.S. Cl. ..... 81/57.13; 81/467

[58] Field of Search ..... 81/56, 57.13, 57.29, 81/57.42, 467, 479

[56] References Cited

U.S. PATENT DOCUMENTS

| | | | |
|---|---|---|---|
| 3,097,551 | 7/1963 | Schmitt . | |
| 3,987,692 | 10/1976 | Lesner et al. | 81/57.13 |
| 4,685,050 | 8/1987 | Polzer et al. | 81/467 |
| 4,969,105 | 11/1990 | Gaenssle | 81/467 |
| 5,172,616 | 12/1992 | Negishi | 81/467 |
| 5,460,062 | 10/1995 | Wilson, Jr. | 81/56 |

FOREIGN PATENT DOCUMENTS

| | | |
|---|---|---|
| 0480380 | 4/1992 | European Pat. Off. . |
| 9012774 | 1/1991 | Germany . |
| 2046155 | 11/1980 | United Kingdom . |

*Primary Examiner*—D. S. Meislin
*Assistant Examiner*—Joni B. Danganan
*Attorney, Agent, or Firm*—Armstrong, Westerman, Hattori, McLeland & Naughton

[57] ABSTRACT

A tightening device comprises an upper plate, a lower plate disposed below the upper plate in parallel thereto, a nut rotating gear supported by the lower plate so as to be rotatable in a horizontal plane, and a spur gear provided on an underside of the upper plate and meshable with the nut rotating gear for rotating the nut rotating gear. The upper plate has a portion fittable to a flange of an externally threaded member for preventing the rotation of the threaded member, while the nut rotating gear has a portion fittable to a nut. With the nut manually tightened on the threaded member in advance, the flange fitting portion of the upper plate is fitted to the flange, the nut is fitted in the fitting portion of the nut rotating gear, and the spur gear is thereafter rotated, whereby the nut rotating gear is driven to tighten up the nut on the threaded member.

18 Claims, 19 Drawing Sheets

TIGHTENING DEVICE

This application is a continuation of application Ser. No. 08/253,738 filed Jun. 3, 1994, now abandoned.

BACKGROUND OF THE INVENTION

The present invention relates to a threaded member tightening method, for example, for use in fastening the components of a pipe joint together with a nut.

Pipe joints are already known which comprise a first tubular joint member having a hexagonal flange and an externally threaded portion, a second tubular joint member disposed end to end therewith, an annular gasket interposed between the opposed end faces of the two joint members, a nut provided on the second joint member and screwed on the first joint member and a thrust bearing provided between the second joint member and the nut.

With the pipe joint, a fluid-tight connection is provided by manually tightening the nut on the first joint member first and thereafter tightening up the nut with a tool with the hexagonal flange of the first joint member held with another tool. To tighten up the nut suitably, a mark is made on each of the first joint member and the nut after the nut has been manually tightened, and the nut is then turned through a required angle with reference to the marks. Alternatively, the nut is turned with a torque wrench serving as the tightening tool until a required torque value is obtained to ensure tightening.

The conventional methods of tightening the pipe joint require two tools, i.e., a tool for holding the first tubular joint member, and another tool for tightening the nut, and therefore have the problem of necessitating a cumbersome tightening procedure.

It is also cumbersome to make a mark on each of the first tubular joint member and the nut which is manually tightened and to turn the nut through the required angle with reference to the marks.

While the worker is likely to forget to install the gasket or thrust bearing when assembling the pipe joint, the conventional methods described are unable to indicate the absence of the gasket or thrust bearing, giving rise to the problem of a leak from the joint portion of piping due to improper tightening.

SUMMARY OF THE INVENTION

An object of the present invention is to provide a tightening device which facilitates the procedure for tightening pipe joints and the like.

Another object of the present invention is a device for tightening up pipe joints or the like without any likelihood of improper tightening.

The present invention provides a device for tightening up a nut screwed on an externally threaded member having a flange, the device comprising a body, a member for preventing rotation of the externally threaded member, the preventing member projecting forward from a front end of the body and having a flange fitting portion open in a predetermined direction, a gear support member attached to the preventing member and having a gear support portion coaxial with the flange fitting portion, a nut rotating gear having a nut fitting portion coaxial with and open generally in the same direction as the flange fitting portion, the gear being supported by the gear support member so as to be rotatable about an axis of the nut fitting portion, a transmission gear attached to the preventing member and meshable with the nut rotating gear to rotate the gear, and means for driving the transmission gear.

With the tightening device of the invention, the nut is manually tightened on the externally threaded member in advance, the flange fitting portion of the preventing member is fitted to the flange of the threaded member, the nut fitting portion of the nut rotating gear is further fitted to the nut, and the transmission gear is thereafter rotated by the driving means, whereby the nut rotating gear is rotated to tighten up the nut on the threaded member. Accordingly, pipe joints or the like can be tightened with greater ease than by the conventional procedure which necessitates two tools, i.e., a tool for holding the threaded member and another tool for tightening the nut.

Preferably, the gear support member is made movable between a position where the nut rotating gear meshes with the transmission gear and a position where the rotating gear is out of mesh with the transmission gear. It is then possible to fit the nut fitting portion to the nut while manually rotating the nut rotating gear as held out of meshing engagement with the transmission gear, consequently facilitating the tightening procedure with use of the present device.

Means for detecting the amount of tightening the nut may be provided. The nut can then be tightened while recognizing the amount of tightening to preclude overtightening or undertightening without necessitating the cumbercome procedure of rotating the nut through a required angle while visually checking the amount of tightening.

Means for detecting the tightening torque may be provided. This enables the worker to tighten the nut while recognizing the tightening torque, whereby undertightening or overtightening is avoidable.

In another aspect of the invention, the device further comprises means for detecting the amount of tightening the nut, means for detecting the tightening torque and means for judging whether the nut is tightened normally from the amount of tightening and tightening torque detected. It is then possible to tighten the threaded member while detecting the amount of tightening and the tightening torque and judging whether the tightening torque is within a reference range relative to the amount of tightening, the reference range of tightening torques being predetermined relative to the amount of tightening of the threaded member as normally tightened. The device therefore precludes overtightening or undertightening without the need for the worker to check whether the threaded member is normally tightened, further enabling the worker to recognize that he has forgotten to install a gasket or thrust bearing, for example, into a pipe joint. This ensures a facilitated tightening procedure and obviates any likelihood of improper tightening.

DESCRIPTION OF THE PREFERRED EMBODIMENTS

Embodiments of the present invention will be described below with reference to the accompanying drawings.

Figure 1:
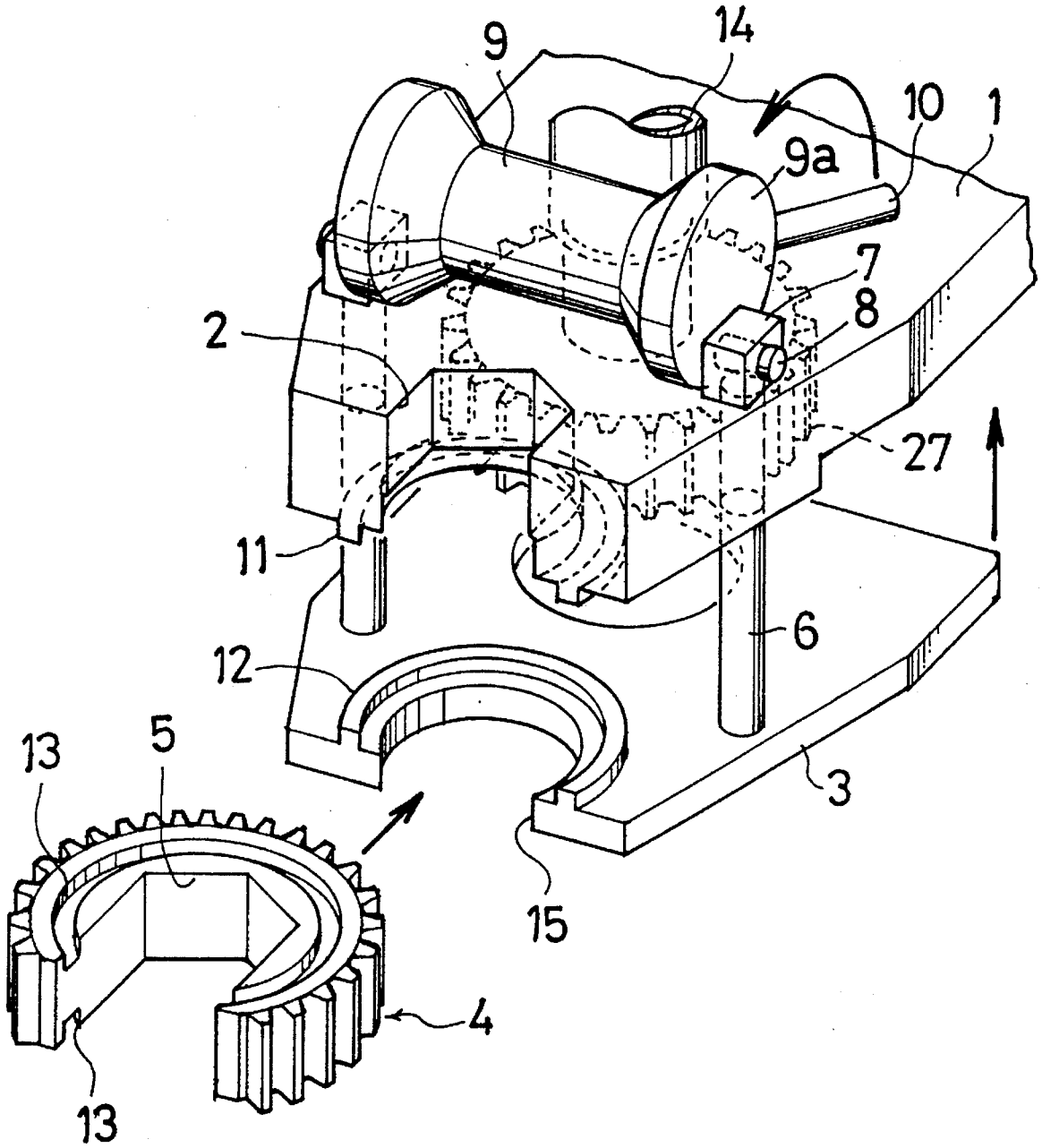
FIG. 1 is an exploded fragmentary perspective view of an electric motor-driven tightening device embodying the invention.
Figure 2:
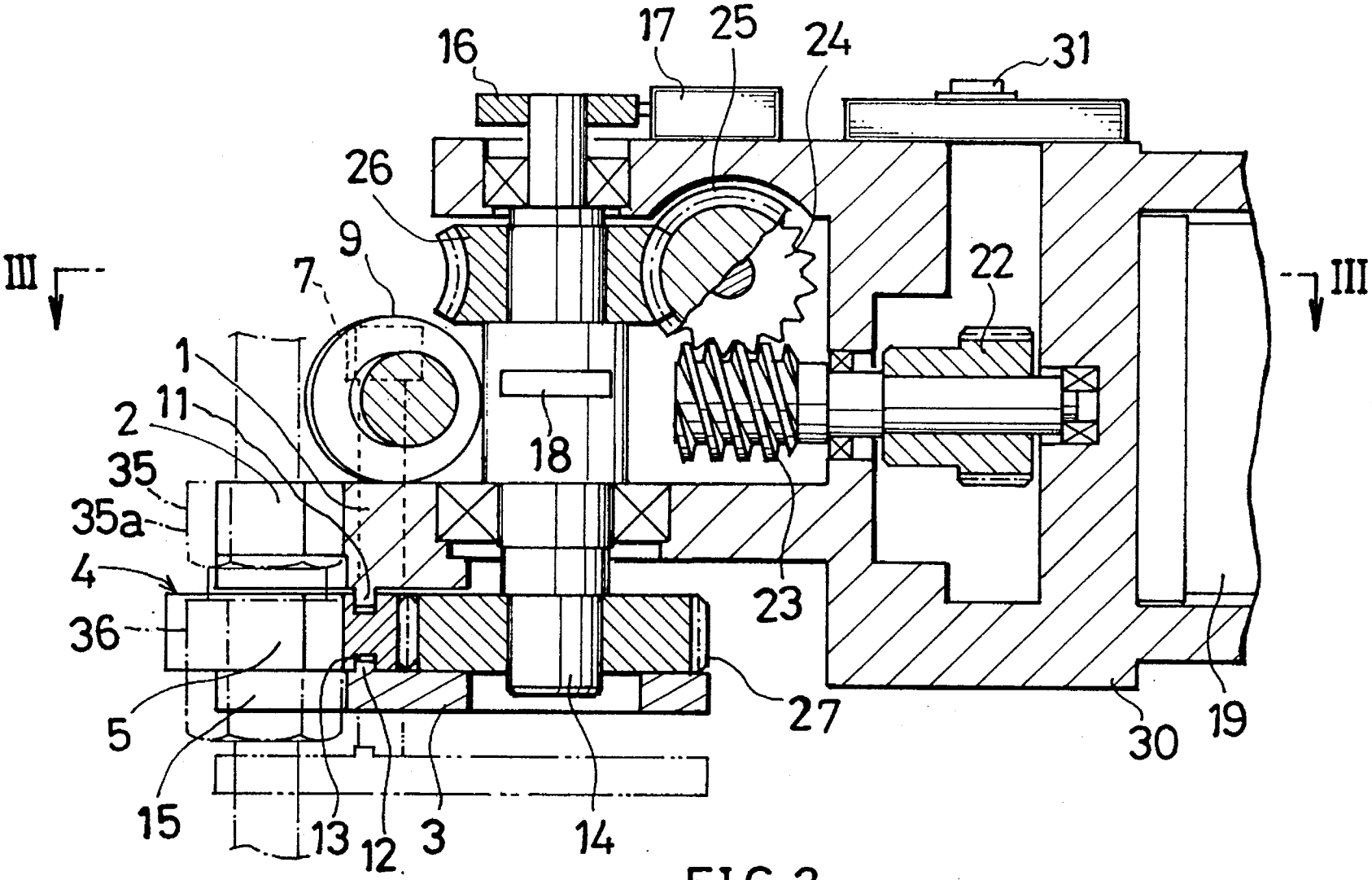
FIG. 2 is a view in vertical section of the same.
Figure 3:
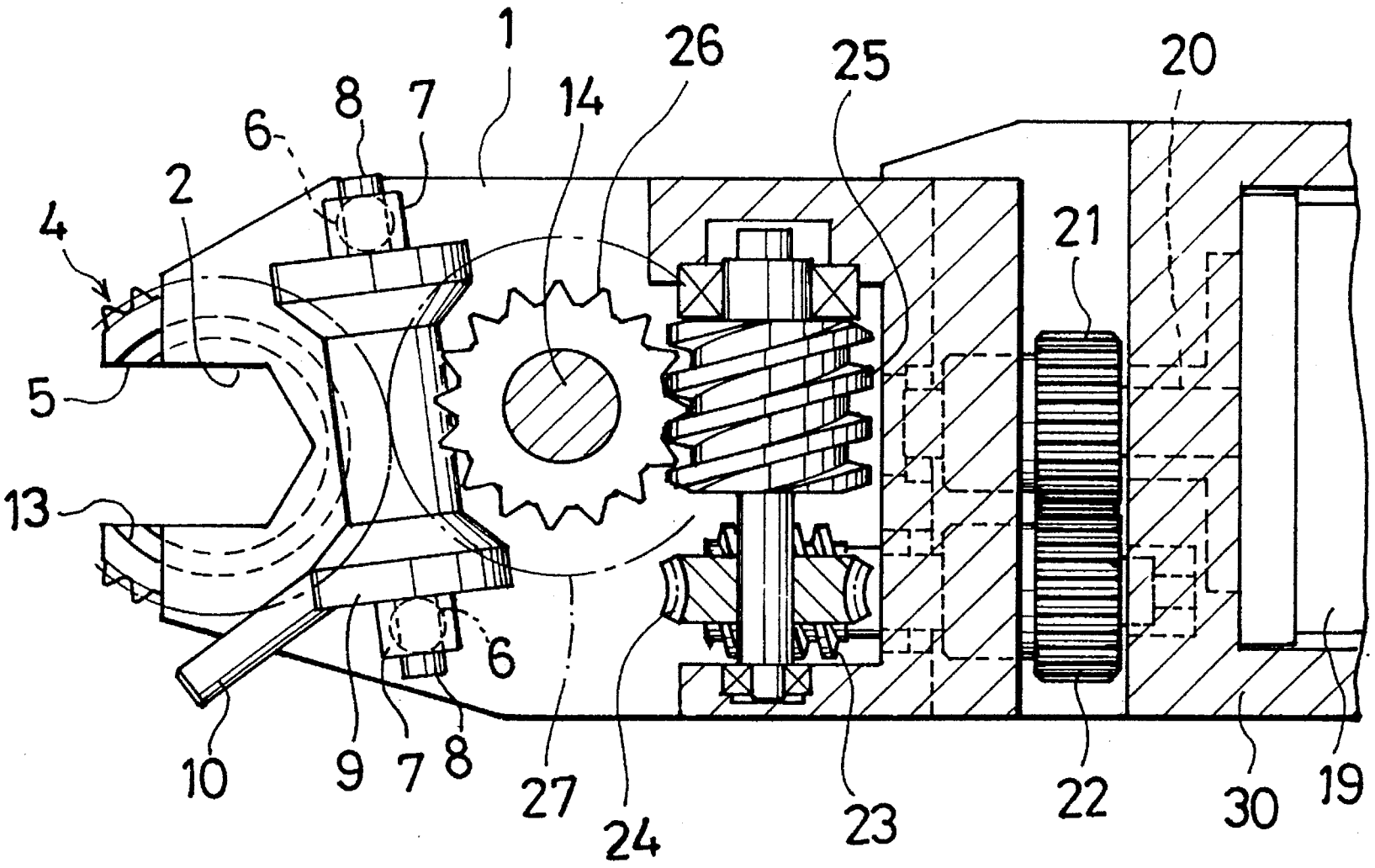
FIG. 3 is a view in section taken along the line III—III in FIG. 2.

In the following description, the terms "upper," "lower," "front" and "rear" are used based on FIG. 2. The upper and lower sides of FIG. 2 will be referred to as "upper" and "lower," respectively, the left-hand side of FIG. 2 as "front" and the right-hand side thereof as "rear." The up-down relation is relative; the illustrated device may be used with the upper side positioned down, laterally or obliquely.

FIGS. 1 to 7 show an electric motor-driven tightening device as an embodiment of tightening device of the present invention.

The device is adapted to fully tighten a nut 36 manually tightened on an externally threaded member 35 having a flange 35*a*. The device comprises an upper plate 1 adapted to prevent the externally threaded member from rotation and projecting forward from the front end of a body 30 housing a d.c. servomotor 19, a gear supporting lower plate 3 disposed under the upper plate 1 in parallel thereto and movable upward and downward, a nut rotating gear 4 mounted on the front end of the lower plate 3 and rotatable in a horizontal plane, and a drive spur gear 27 interposed between the upper plate 1 and the lower plate 3 and meshing with the gear 4 for rotating the gear.

The upper plate 1 is formed at its front end with a flange fitting portion 2 which is open toward the front. The flange fitting portion 2, which corresponds to the head of a spanner, has an opening width in conformity with the external size of the flange 35*a* of the externally threaded member 35. The threaded member 35 is prevented from rotation when the flange 35*a* thereof is fitted into the portion 2.

The lower plate 3 is formed at its front end with a nut fitting portion 15 coaxial with the flange fitting portion 2 and open toward the front. The nut fitting portion 15 is partly circular and slightly larger than the nut 36 in cross sectional area so as not to prevent rotation of the nut 36.

The front end of the lower plate 3 is provided on its upper surface with a circular-arc upward projection 12 coaxial with the flange fitting portion 2, while the front end of the upper plate 1 is formed on its lower surface with a circular-arc downward projection 11 coaxial with the flange fitting portion 2.

The nut rotating gear 4 is a spur gear having a portion 5 for the nut 36 to fit in. With the gear 4 supported on the lower plate 3, the nut fitting portion 5 is coaxial with the flange fitting portion 2. The portion 5 is open toward the front to removably fit the nut 36 thereinto and has an opening size in conformity with the external size of the nut 36. The gear 4 is formed in its upper and lower sides with upper and lower grooves 13 for the downward projection 11 of the upper plate 1 and the upward projection 12 of the lower plate 3 to fit in, respectively.

The gear 4 is rotated counterclockwise when seen from above by being driven by the spur gear 27 meshing therewith. The spur gear 27 in mesh with the nut rotating gear 4 is mounted on and rotatable with a vertical rotary shaft 14 extending through the upper plate 1 close to the front end thereof.

The lower plate 3 has two vertical guide rods 6 each extending through the upper plate 1. Each rod 6 has an upper end fixedly provided with a rectangular parallelepipedal block 7, and a lower end fixed to the lower plate 3. A cylindrical eccentric roller 9 having an outer flange 9*a* at each end is disposed on the upper surface of the upper plate 1. The eccentric roller 9 is rotatably attached to the block 7 by a pin 8 at an eccentric position on each flange 9*a*. The roller 9 has a lever 10 attached thereto. When moved, the lever 10 rotates the roller 9 to move the lower plate 3 upward or downward relative to the upper plate 1 while these plates 1, 3 are being held in parallel.

The eccentric roller 9 rotates as always held in contact with the upper surface of the upper plate 1 by gravity acting on the roller 9 itself and on the lower plate 3 and vertical guide rods 6 connected thereto. When the pins 8 are in the highest position, the upper surface of the lower plate 3 is in contact with the lower surface of the spur gear 27, with the nut rotating gear 4 meshing with the gear 27 for rotating the gear 4. In this state, the projections 11, 12 of the upper and lower plates 1, 3 are fitted in the respective upper and lower circular-arc grooves 13, 13 of the gear 4, rendering the gear 4 rotatable about a vertical axis immediately below the flange fitting portion 2 of the upper plate 1 by being guided by the two projections 11, 12. A small clearance is formed between the upper surface of the lower plate 3 and the lower surface of the upper plate 1 and between the bottom face of the groove 13 of the gear 4 and the lower face of the projection 11 of the upper plate 1 so that the gear 4 is movable upward or downward (see FIGS. 2, 5 and 6, (*a*)).

Figures 6A, 6B, 6C:
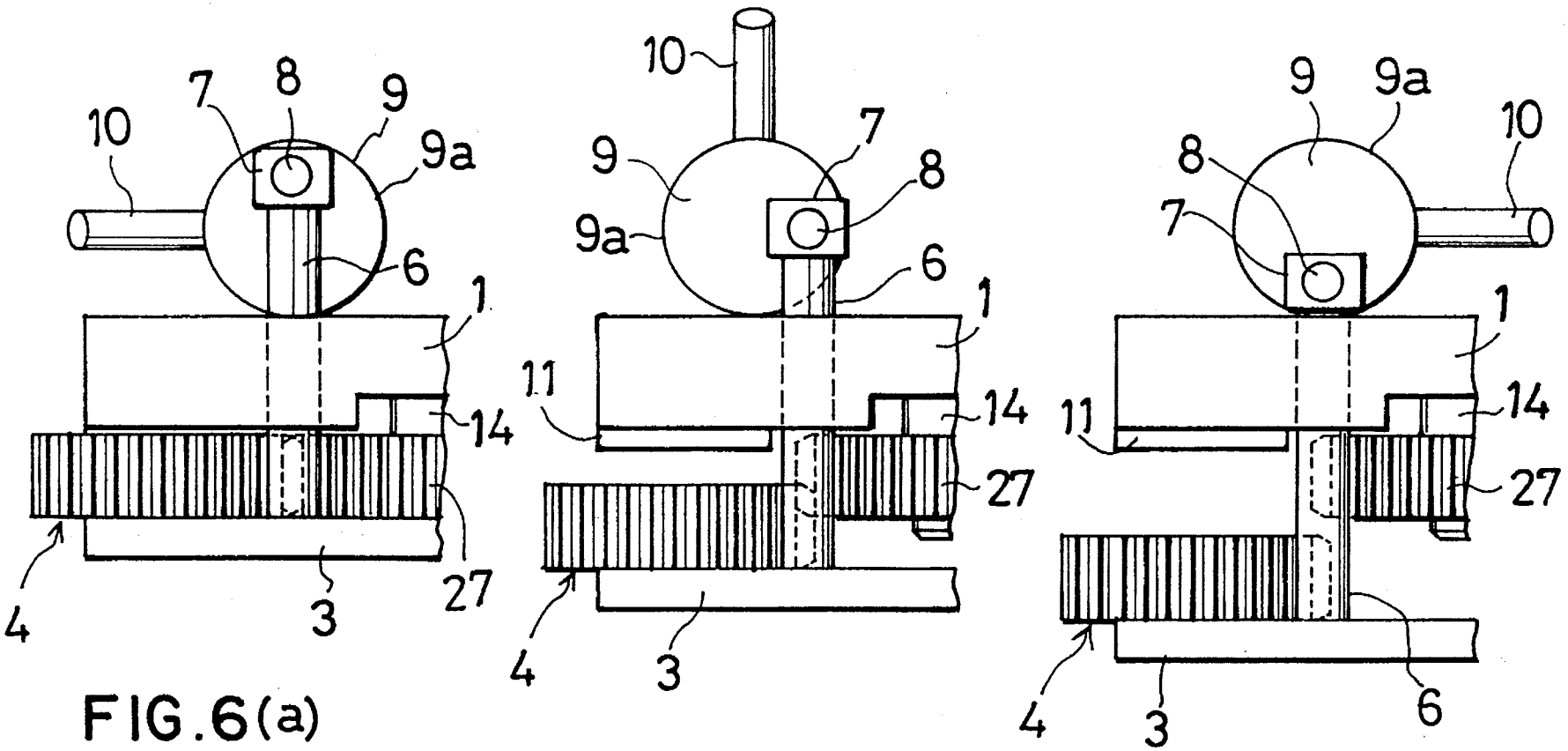
FIGS. 6, (*a*), (*b*) and (*c*) are side elevations showing an eccentric roller and a lower plate in operation.

When the eccentric roller 9 is rotated through 90 deg from the above position, the nut rotating gear 4 is brought to a position where it is in mesh with the spur gear 27 only slightly (see FIG. 6, (*b*)). When the roller 9 further rotates through 90 deg from this position, bringing the pins 8 to the lowest position, the lower plate 3 is away from the upper plate 1 by the largest distance, with the gear 4 brought out of meshing engagement with the spur gear 27 for driving the gear 4 (see FIG. 6, (*c*)).

The vertical rotary shaft 14 carrying the drive spur gear 27 for the nut rotating gear 4 is rotated by the d.c. servomotor 19 and a train of gears. More specifically, the servomotor 19 has a drive shaft 20 which is rotatable clockwise when seen from the rear toward the front and which carries a spur gear 21. Meshing with this gear 21 is another spur gear 22 having a horizontal rotary shaft in parallel with the shaft 20. A worm 23 mounted on the shaft of the spur gear 22 is in mesh with a worm wheel 24 having a horizontal rotary shaft, which is provided with another worm 25. A worm wheel 26 meshing with the worm 25 is attached to the vertical rotary shaft 14.

Figure 4:
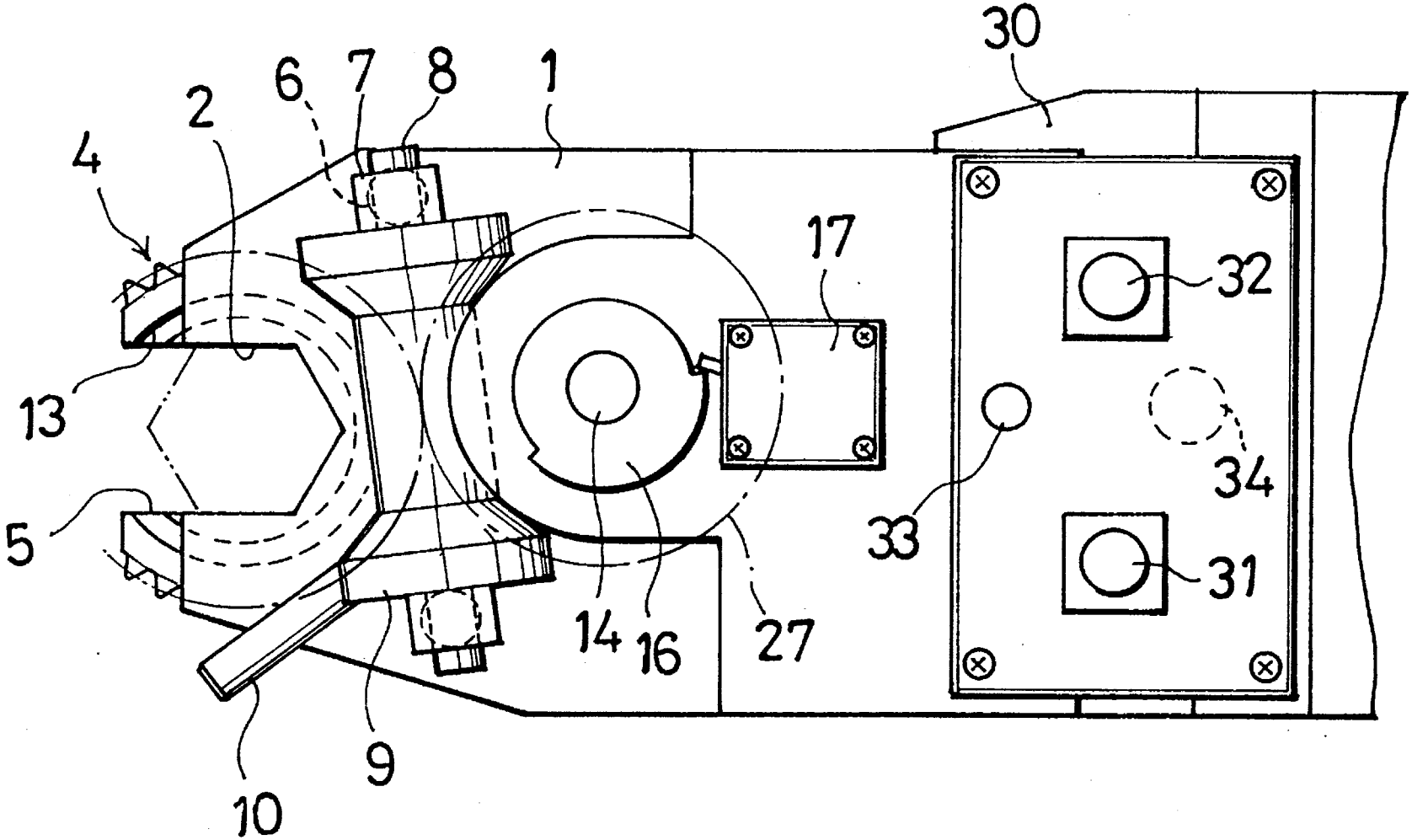
FIG. 4 is a fragmentary plan view showing the tightening device of FIG. 1.
Figure 5:
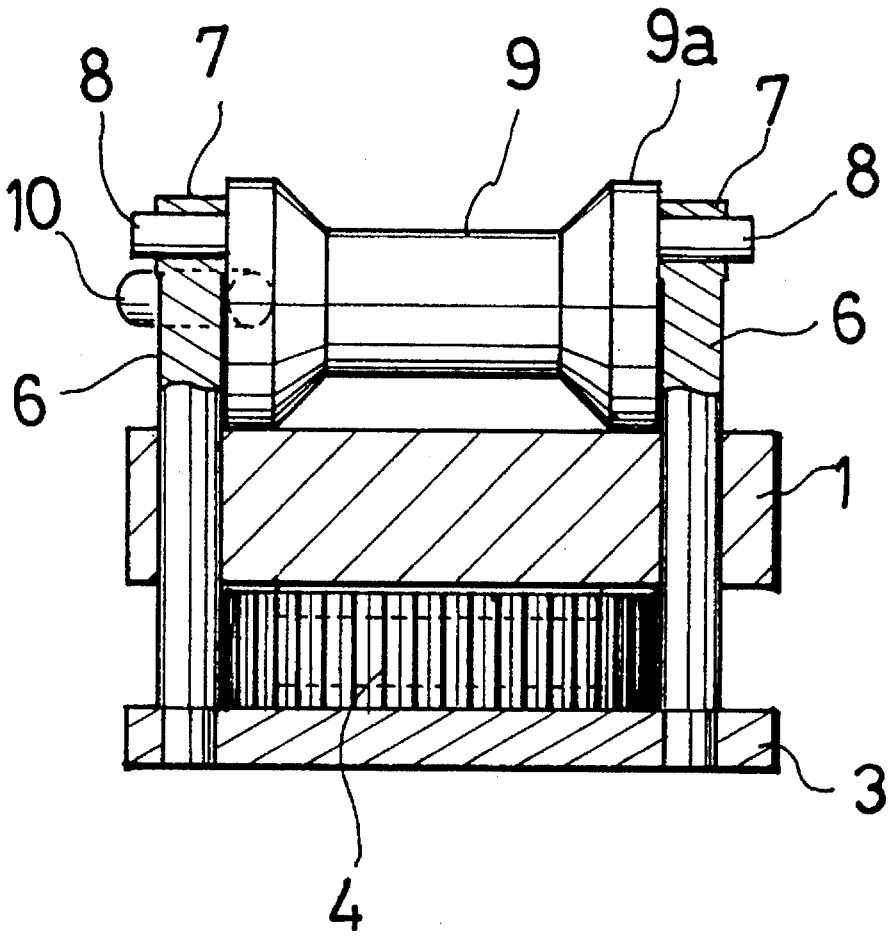
FIG. 5 is a view in cross section of the same.

The train of gears described is housed in the body 30. As seen in FIG. 4, provided on the top of the body 30 are a start button 31, emergency stop button 32, light-emitting diode 33 and alarm buzzer 34.

The vertical rotary shaft 14 is provided at its upper end with a rotary plate 16 rotatable therewith for use in counting the number of revolutions of the shaft 14 by a rotation angle sensor 17, which converts the number to an angle of rotation of the nut. A strain gauge 18 is affixed to the peripheral surface of the rotary shaft 14, and the amount of strain of the shaft 14 is converted to a fastening torque by a fastening torque sensor 28.

The nut 36 is tightened on the externally threaded member 35 by the above device in the following manner.

First, the nut 36 is tightened on the threaded member 35 manually. The lower plate 3 is positioned at the largest distance from the upper plate 1. Next, the flange fitting portion 2 of the upper plate 1 is fitted to the flange 35*a* of the threaded member 35, and the nut 36 is positioned above the nut fitting portion 15. The nut rotating gear 4 is then placed on the lower plate 3 with the nut fitting portion 5 fitted to the nut 36. The eccentric roller 9 is thereafter rotated to move the lower plate 3 toward the upper plate 1 and mesh the gear 4 with the drive spur gear 27 while finely adjusting the gear 4 manually, whereby the device is made ready for operation. The start button 31 is then pressed. The nut 36 is automatically tightened up completely with judgment made as to whether it is tightened normally.

Figure 7:
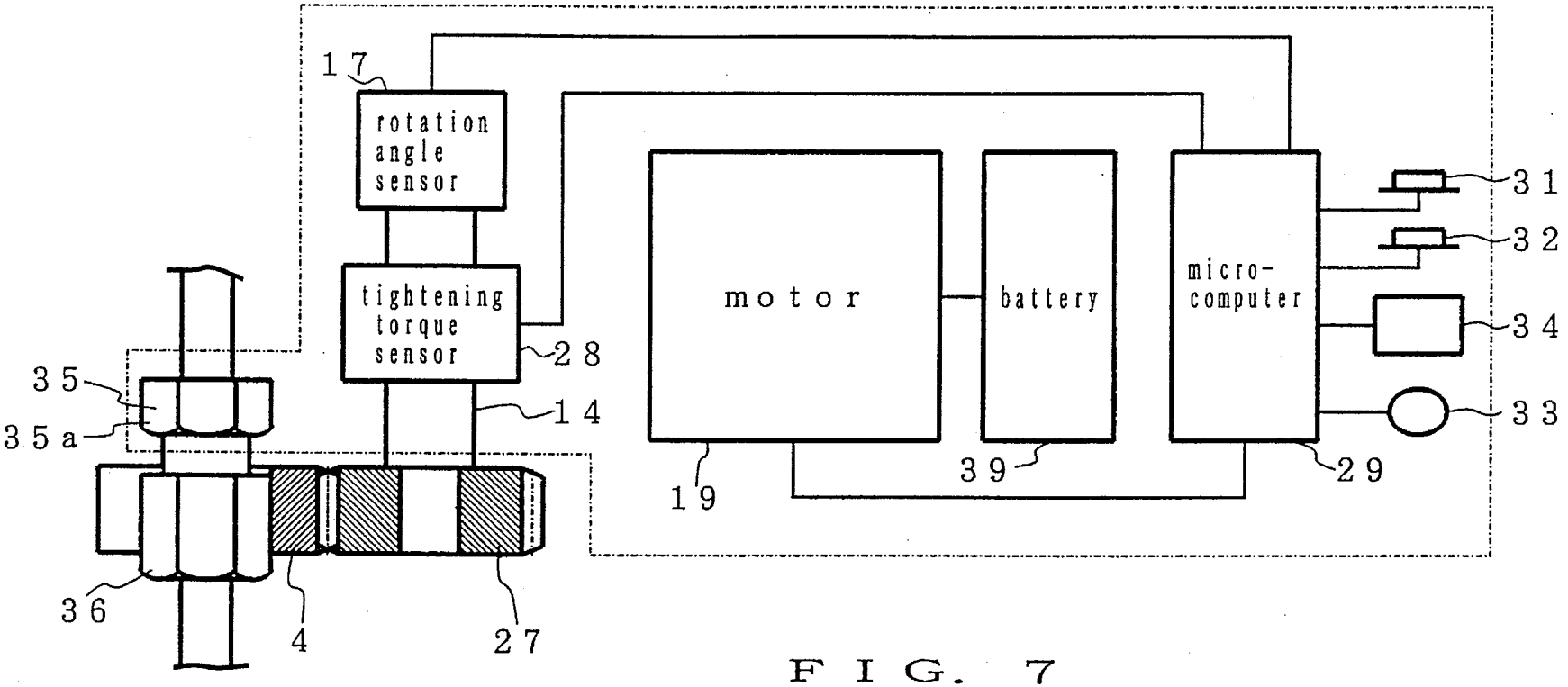
FIG. 7 is a block diagram showing an embodiment of tightening judging means for use in the device of the invention.

With reference to the block diagram of FIG. 7, the tightening torque detected by the torque sensor 28 and the rotation angle detected by the angle sensor 17 are fed to a microcomputer 29, which judges whether the nut is tightened normally by the judging procedure to be described below. The result is output from the light-emitting diode 33 and the alarm buzzer 34. The microcomputer 29 feeds to the servomotor 19 a command, for example, as to the rotation speed or angle, reverse rotation or stopping of the nut 36.

The diode 33 presents, for example, green light indicating normal tightening or red light indicating abnormal tightening, or is turned on when made ready for checking, turned off to indicate normal tightening or flickered to indicate abnormal tightening. The alarm buzzer 34 goes on, for example, once to indicate normal tightening or three times to indicate abnormal tightening.

Figure 8:
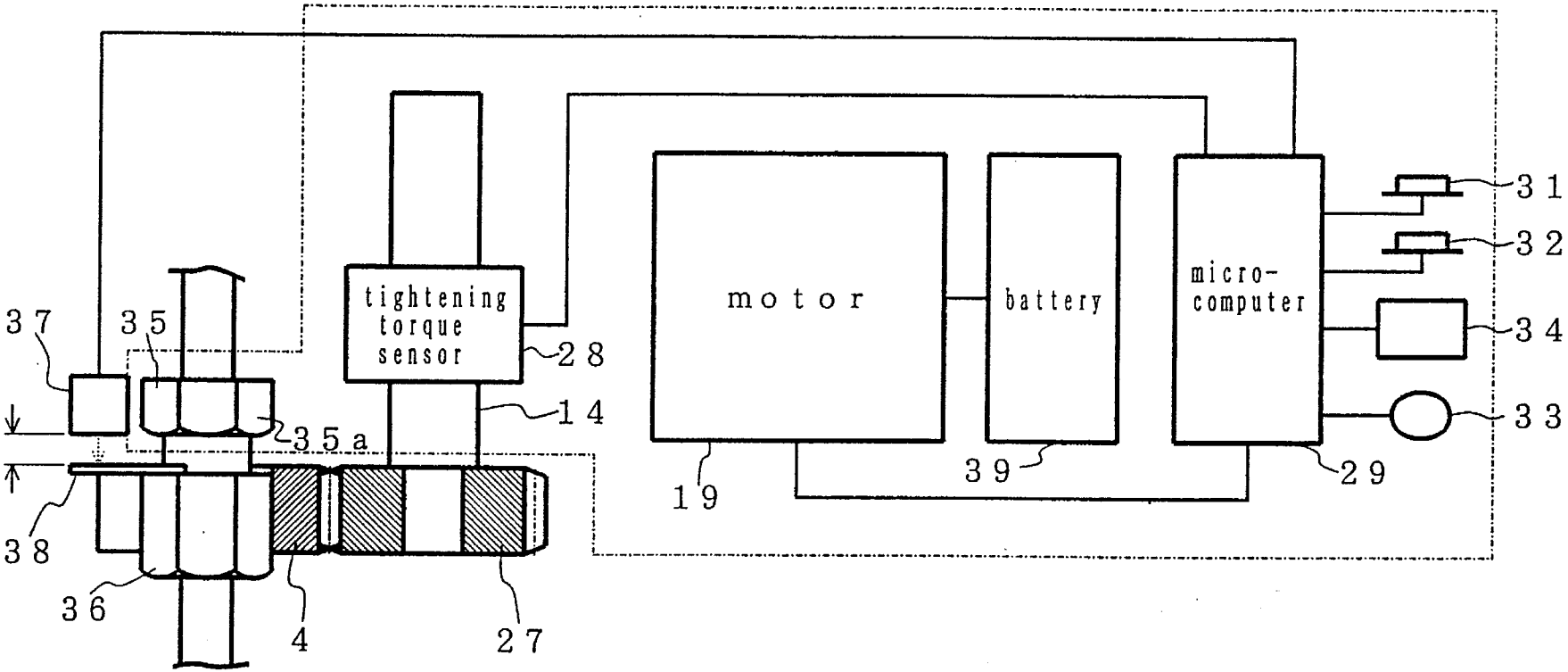
FIG. 8 is a block diagram of another embodiment of the same.

FIG. 8 is a block diagram showing judging means which is adapted to detect the amount of tightening of the nut 36 in terms of the displacement of the nut 36 relative to the externally threaded member 35 instead of the angle of rotation. In this case, the threaded member 35 is provided, for example, with a displacement sensor 37 of the laser type, and a laser beam receiving member 38 is attached to the end face of the nut 36 opposed to the threaded member 35. The displacement sensor 37 may be provided on the nut 36.

Figure 9:
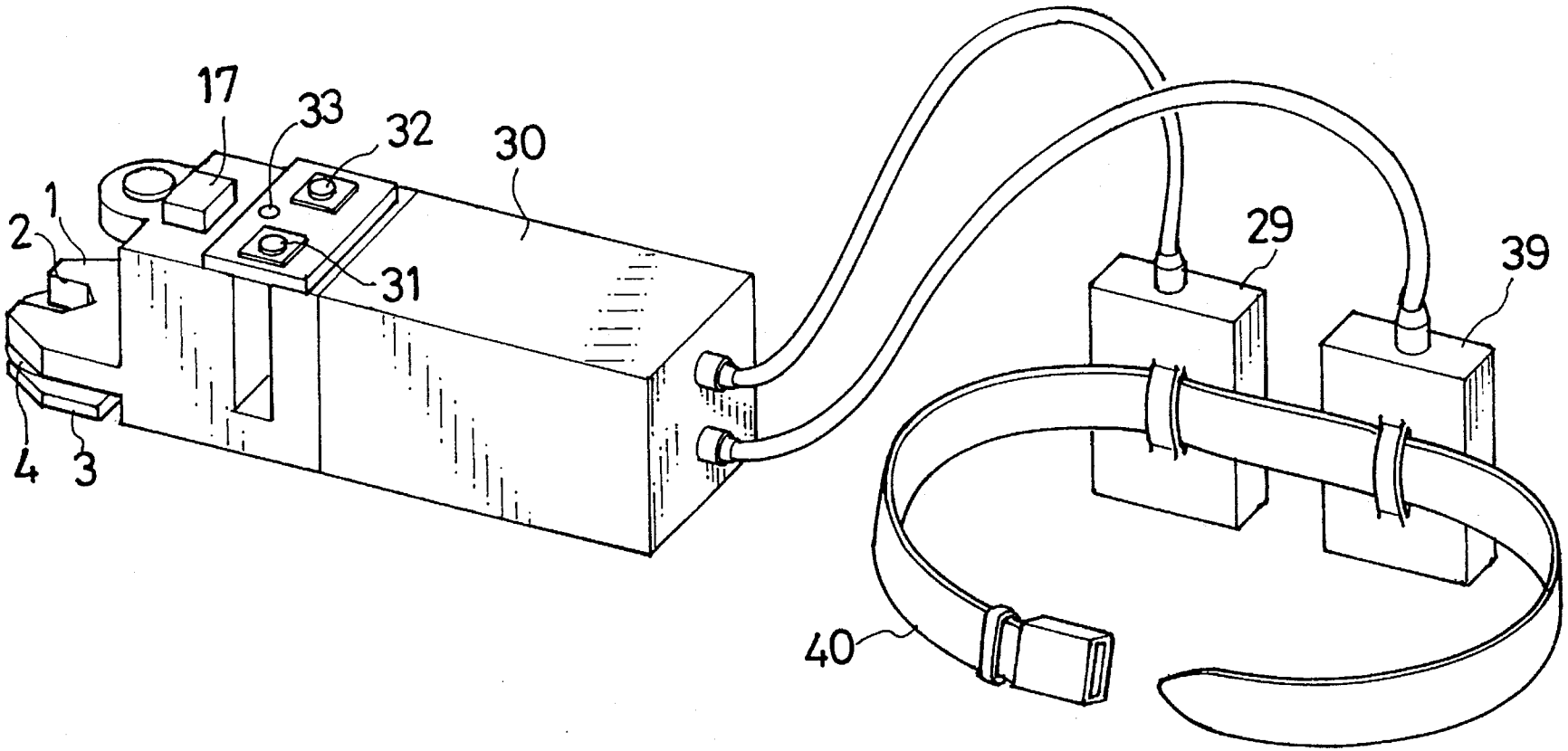
FIG. 9 is a perspective view schematically showing an embodiment of a control unit for use in the tightening device of FIG. 1.

A motor drive battery 39 and the microcomputer 29 may be incorporated into the tightening device, or separated from the main body of the tightening device and attached, for example, to a band 40 as seen in FIG. 9. Alternatively, it is possible to provide the battery 39 and the microcomputer 29 as a unit, or to separate the battery 39 only from the tightening device wherein the microcomputer 29 is incorporated.

Figure 10:
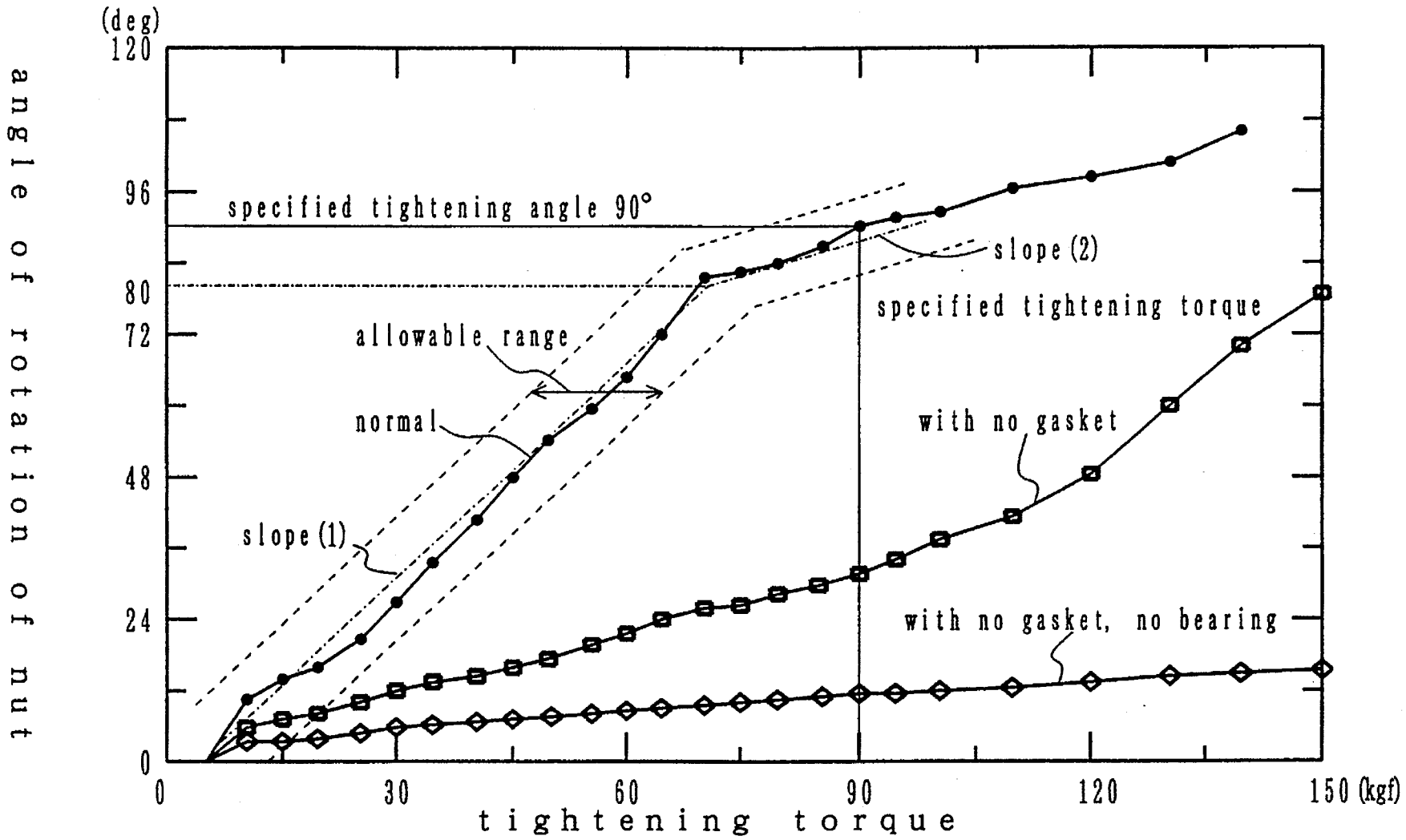
FIG. 10 is a graph showing the relationship between the angle of rotation of a nut and the tightening torque.

FIG. 10 shows the relationship between the tightening angle and the tightening torque involved in tightening up a pipe joint which comprises a first tubular joint member (externally threaded member) 35 having an externally threaded portion and a hexagonal flange, a second tubular joint member, an annular gasket interposed between opposed ends of the two joint members, a nut 36 provided on the second tubular joint member and screwed on the first tubular joint member (externally threaded member) 35, and a thrust bearing provided between the second joint member and the nut 36. The relationship was determined in a normal case and also in abnormal cases wherein the gasket, or both gasket and thrust bearing were absent while assembling the pipe joint by manually tightening the nut 36 on the threaded member 35 first and thereafter tightening up the nut 36 with a wrench. In the normal case shown in FIG. 10, the tightening torque increases in a linear relation (slope (1)) with the nut tightening angle as the nut 36 is tightened until the angle increases to about 80 deg. The slope alters at the nut tightening angle of about 80 deg, and the tightening torque thereafter increases in a linear relation (slope (2)). When the worker forgot to install the gasket, the increase in the tightening torque is greater than in the normal case to exhibit a different slope. When the worker forgot to install both the gasket and the thrust bearing, the tightening torque increases at a greater rate, exhibiting a slope different from the slope in the absence of the gasket only.

These results indicate that the value of tightening torque relative to the tightening angle and the slope (gradient) of tightening torque are each usable as a reference value in judging tightening.

Figure 11:
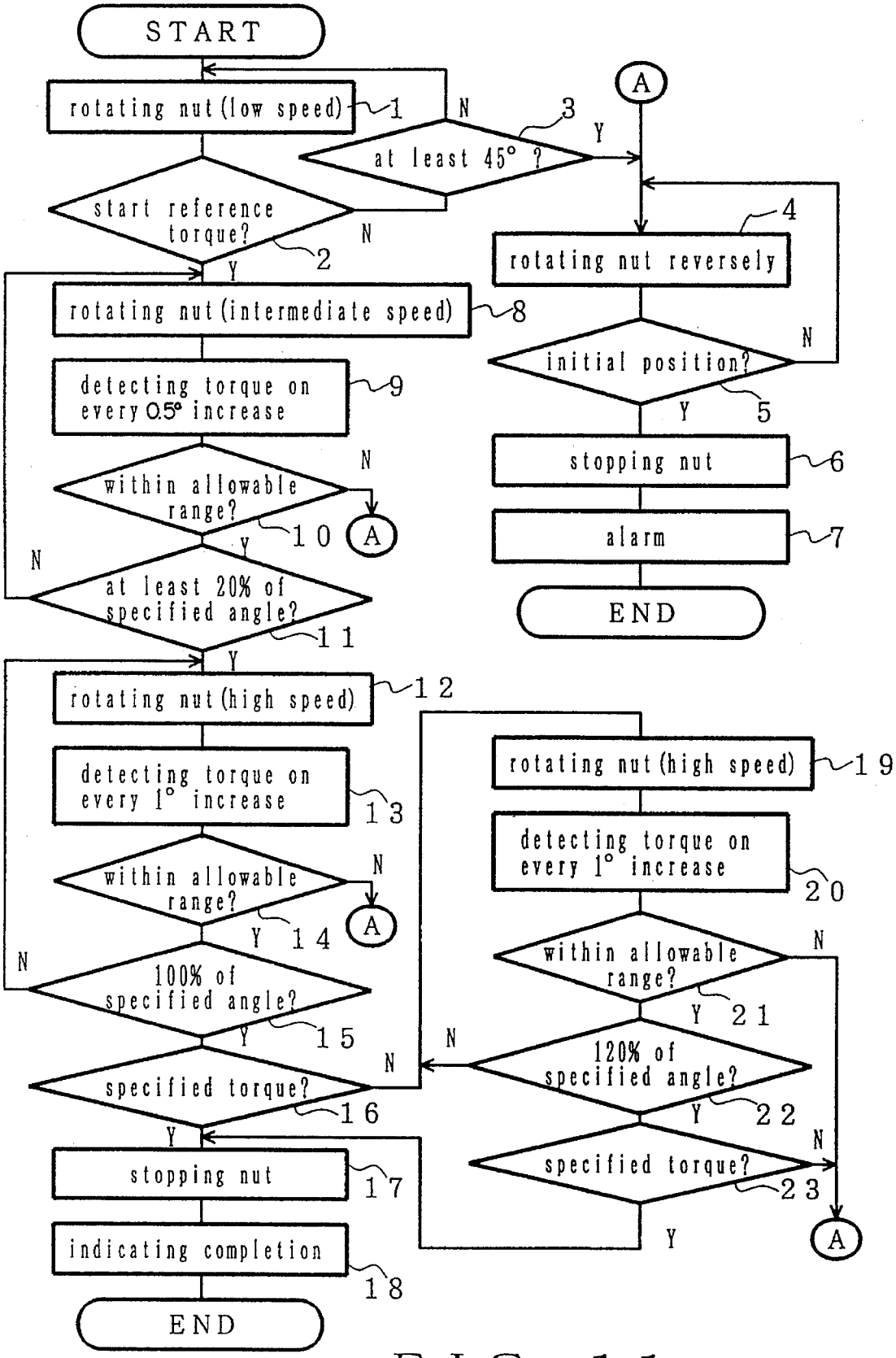
FIG. 11 is a flow chart generally showing a tightening method which is practiced while detecting the rotation angle of the nut and tightening torque.

Next, an example of tightening method will be described with reference to the flow chart of FIG. 11.

The nut 36 is manually tightened on the externally threaded member 35 in advance, followed by tightening by the tightening device. In the beginning, the nut is rotated at a low speed (step 1), and an inquiry is made as to whether the tightening torque has reached a tightening start reference torque (step 2). If the answer to the inquiry is negative, whether the amount of rotation of the nut is at least 45 deg is checked (step 3). If it is less than 45 deg, step 3 is followed by step 1 again. When the amount is found to be at least 45 deg in step 3, this is interpreted as indicating improper tightening due to manual undertightening, and the sequence proceeds to step 4. The nut is reversely rotated in step 4 and then checked as to whether the nut is returned to the initial position (step 5). If the nut is in the initial position, the reverse rotation of the nut is discontinued (step 6), whereupon an alarm indicating improper tightening is given to terminate the tightening operation (step 7). When the answer to the inquiry of step 2 is affirmative, the nut is rotated at a higher speed (step 8), and the tightening torque is detected every time the amount of rotation of the nut increases by 0.5 deg (step 9), and then checked as to whether the torque is within an allowable range (step 10). If the tightening torque is not within the allowable range, the result is interpreted as indicating improper tightening, whereupon step 4 follows. When the tightening torque is found to be within the allowable range in step 10, an inquiry is made as to whether the rotation angle of the nut is at least 20% of the specified angle of rotation (step 11). If the answer to step 11 is negative, the sequence returns to step 8. When the answer to the inquiry of step 11 is in the affirmative, the nut is rotated at a further increased speed (step 12), and the tightening torque is detected every time the amount of rotation of the nut increases by 1 deg (step 13). An inquiry is made again as to whether the tightening torque is within an allowable range (step 14). If the answer to step 14 is negative, the result is interpreted as indicating improper tightening, and step 4 follows. When the answer to step 14 is affirmative, an inquiry is made as to whether the rotation angle of the nut has reached 100% of the specified tightening angle (step 15). If the answer to the inquiry of step 15 is negative, the sequence returns to step 12. If the answer is affirmative, whether the tightening torque has reached the specified tightening torque is inquired (step 16). When the answer to the inquiry is in the affirmative, this is interpreted as indicating that the tightened nut is acceptable, and the rotation of nut is stopped (step 17), whereupon completion of proper tightening is indicated (step 18). If the answer to the inquiry of step 16 is negative, the nut is further rotated (step 19), and the tightening torque is detected every time the amount of rotation of the nut increases by 1 deg (step 20) and checked as to whether the torque is within an allowable range (step 21). When the answer to the inquiry of step 21 is in the negative, the result is interpreted as indicating improper tightening, and step 4 follows. When the answer to the inquiry of step 21 is affirmative, an inquiry is made as to whether the rotation angle of the nut has reached 120% of the specified tightening angle (step 22). If the answer to this inquiry is negative, step 19 follows. When the answer to the inquiry of step 22 is affirmative, an inquiry is made as to whether the tightening torque has reached the specified tightening torque (step 23). When the answer to the inquiry of step 23 is negative, the result is interpreted as indicating improper tightening, followed by step 4. When the answer to the inquiry of step 23 is affirmative, the result is interpreted as indicating acceptable tightening, and the sequence proceeds to step 17.

Figure 12:
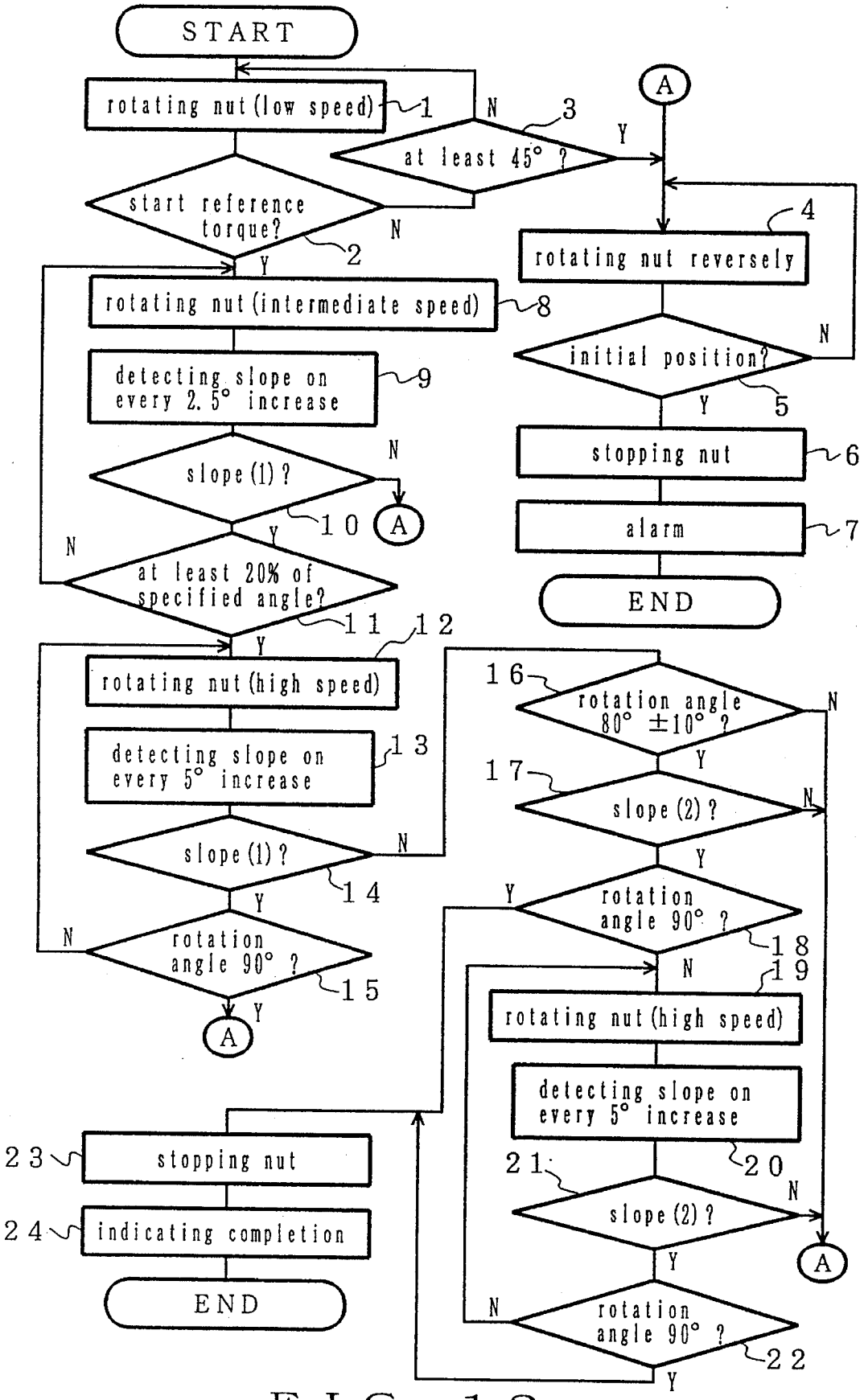
FIG. 12 is a flow chart generally showing a tightening method wherein the rotation angle of the nut and the slope of tightening torque are detected.

Next with reference to the flow chart of FIG. 12, another tightening method will be described wherein the slope of tightening torque is used for judgment.

With the nut tightened manually in advance, tightening by the tightening device is started. In the beginning, the nut is rotated at a low speed (step 1), and an inquiry is made as to whether the tightening torque has reached a tightening start reference torque (step 2). If the answer to the inquiry is negative, whether the amount of rotation of the nut is at least 45 deg is checked (step 3). If it is less than 45 deg, step 3 is followed by step 1 again. When the amount is found to be at least 45 deg in step 3, this is interpreted as indicating improper tightening due to manual undertightening, and the sequence proceeds to step 4. The nut is reversely rotated in step 4 and then checked as to whether the nut is returned to the initial position (step 5). If the nut is in the initial position, the reverse rotation of the nut is discontinued (step 6), whereupon an alarm indicating improper tightening is given to terminate the tightening operation (step 7). When the answer to the inquiry of step 2 is affirmative, the nut is rotated at a higher speed (step 8), and the slope of tightening torque is detected every time the amount of rotation of the nut increases by 2.5 deg (step 9), and then checked as to whether the torque slope is within an allowable range (step 10). If the slope is not within the allowable range, the result is interpreted as indicating improper tightening, whereupon step 4 follows. When the tightening torque slope is found to be within the allowable range in step 10, an inquiry is made as to whether the rotation angle of the nut is at least 20% of the specified tightening angle (step 11). If the answer to step 11 is negative, the sequence returns to step 8. When the answer to the inquiry of step 11 is in the affirmative, the nut is rotated at a further increased speed (step 12), and the slope of tightening torque is detected every time the amount of rotation of the nut increases by 5 deg (step 13). An inquiry is made again as to whether the tightening torque slope is within an allowable range (step 14). If the answer to step 14 is affirmative, an inquiry is made as to whether the rotation angle of the nut has reached 90 deg (step 15). If the answer to the inquiry of step 15 is negative, the sequence returns to step 12. When the rotation angle of the nut is found to be at least 90 deg in step 15, the result is interpreted as indicating improper tightening, followed by step 4. If the answer to the inquiry of step 14 is negative, an inquiry is made in step 16 as to whether the rotation angle of the nut is within the range of 70 to 90 deg. When the answer is negative, this is interpreted as indicating improper tightening, and step 4 follows. When the answer is affirmative, an inquiry is made as to whether the torque slope is within an allowable range of slope (2) (step 17). When the answer to the inquiry of step 17 is negative, the result is interpreted as indicating improper tightening, and step 4 follows. If the answer to the inquiry of step 17 is affirmative, an inquiry is made as to whether the rotation angle of the nut has reached 90 deg (step 18). When the angle is found to be 90 deg in step 18, the result is interpreted as indicating acceptable tightening, and the nut is stopped (step 23), whereupon completion of proper tightening is indicated (step 24). If the answer to step 18 is negative, the nut is further rotated (step 19), and the tightening torque slope is detected every time the amount of rotation of the nut increases by 5 deg (step 20) and checked as to whether the slope is within an allowable range of slope (2) (step 21). When the answer to the inquiry of step 21 is in the negative, the result is interpreted as indicating improper tightening, and step 4 follows. When the answer to the inquiry of step 21 is affirmative, an inquiry is made as to whether the rotation angle of the nut has reached 90 deg (step 22). If the answer to the inquiry of step 22 is negative, step 19 follows. When the answer to the inquiry of step 22 is affirmative, the result is interpreted as indicating proper tightening, whereupon the sequence proceeds to step 23.

The allowable range in the foregoing embodiment is −10% to +10% of the tightening torque, serving as a full scale, at the specified tightening angle. The nut is rotated through an angle of 0 to 20% at about 50% of the rate for the rotation angle of 20 to 100%.

The numerical values, such as 20%, 90 deg and 1-deg increase, relating to the angle of rotation and mentioned above are all examples; suitable values of rotation angles and the like are set in the micro-computer 29 in accordance with the properties of the member to be tightened.

For starting tightening, a reference position is selected where the tightening torque is about 7 kgf-cm. Even if a small tightening torque is produced by manual tighening due to a bent or shift in the piping or even in the event of insufficient manual tightening, the reference position for the start of tighening can then be free of the resulting influence.

Although proper tightening of the nut 36 is judged from the relation between the rotation angle of the nut and the tightening torque in the foregoing embodiment, the distance between the nut 36 and the externally threaded member 35 is usable instead of the rotation angle of the nut 36. Alternatively, both the rotation angle of the nut 36 and the distance between the nut 36 and the threaded member 35 may be used. The distance between the nut 36 and the threaded member 35 can be detected by a potentiometer, eddy current displacement sensor, laser-type displacement sensor or the like.

Although the tightening torque is detected by the strain gauge 18 in the foregoing embodiment, the torque is detectable by other means, for example, by a magnetostrictive torque sensor. The rotation angle can be detected by using a potentiometer to obtain an analog signal and converting the signal to an angle.

Figure 13:
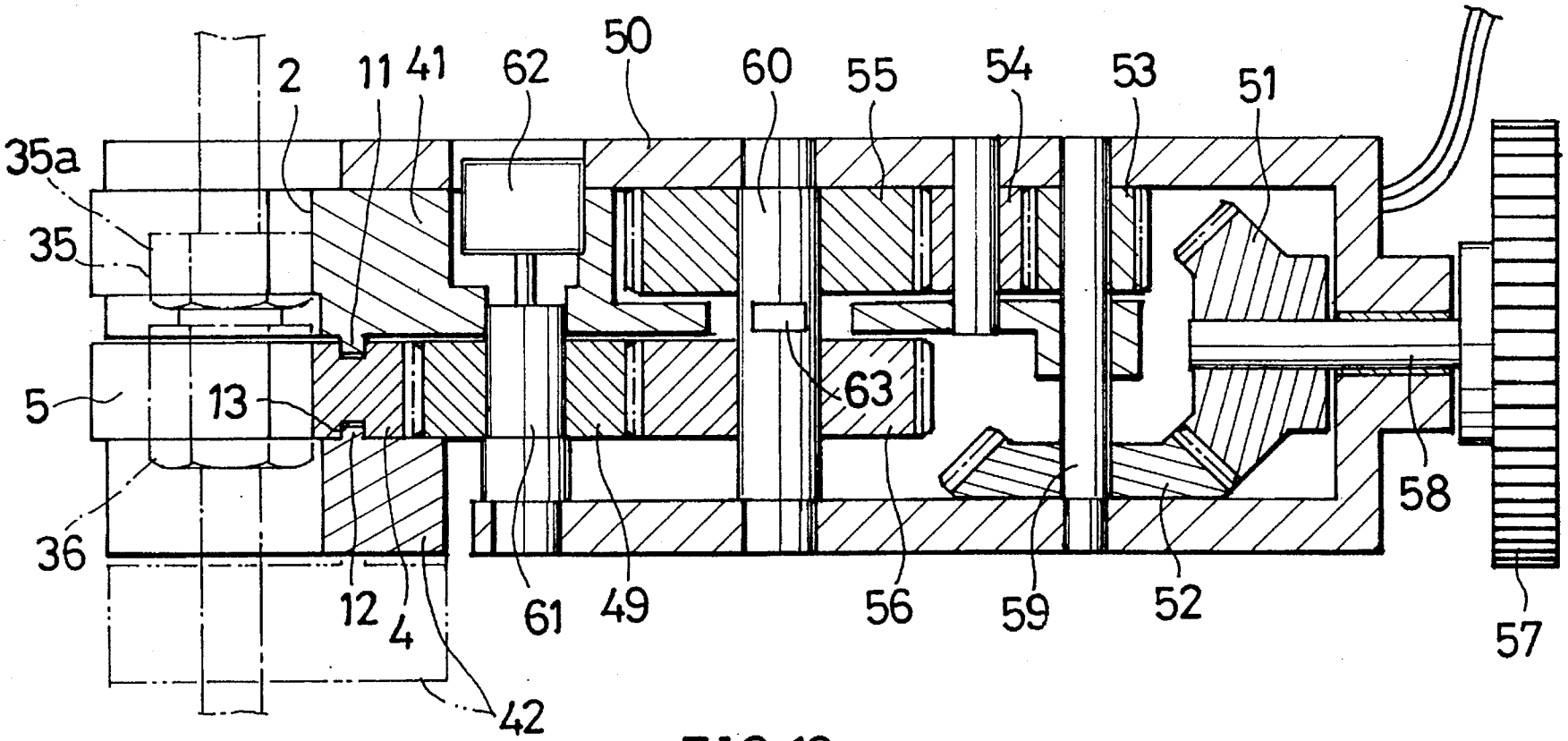
FIG. 13 is a view in vertical section showing a manual tightening device embodying the invention.
Figure 14:
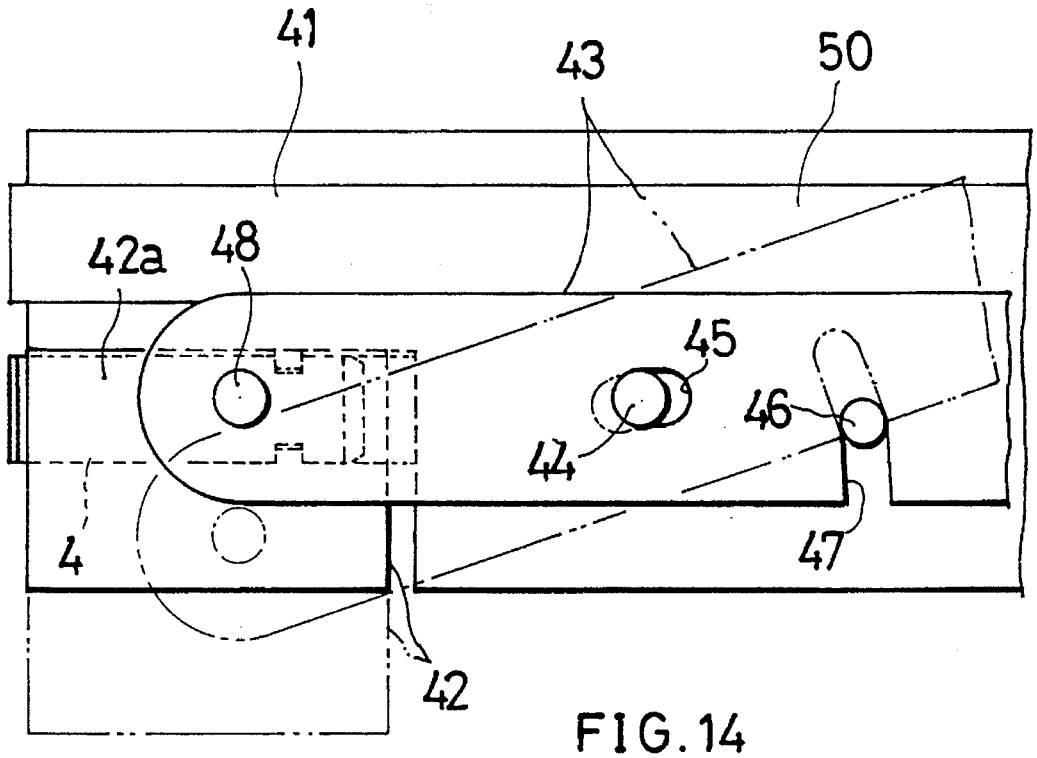
FIG. 14 is a fragmentary side elevation of the same.
Figure 15:
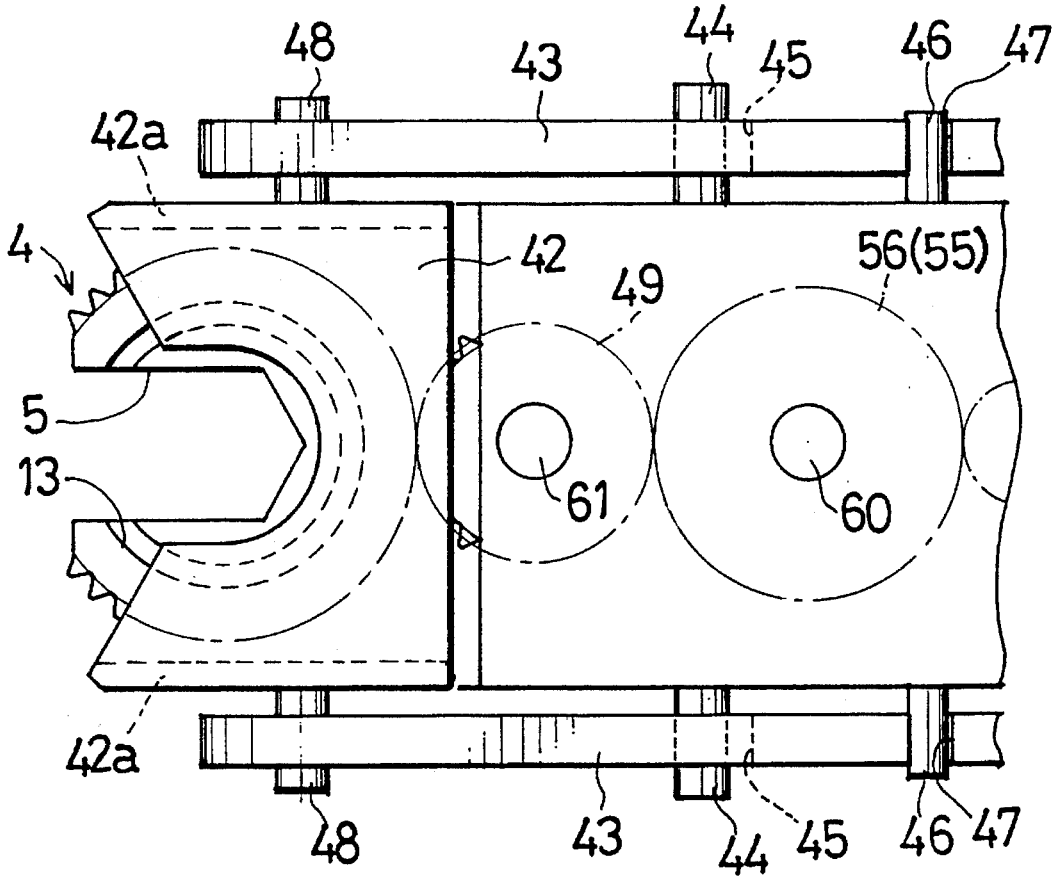
FIG. 15 is a fragmentary plan view of the same.
Figure 16:
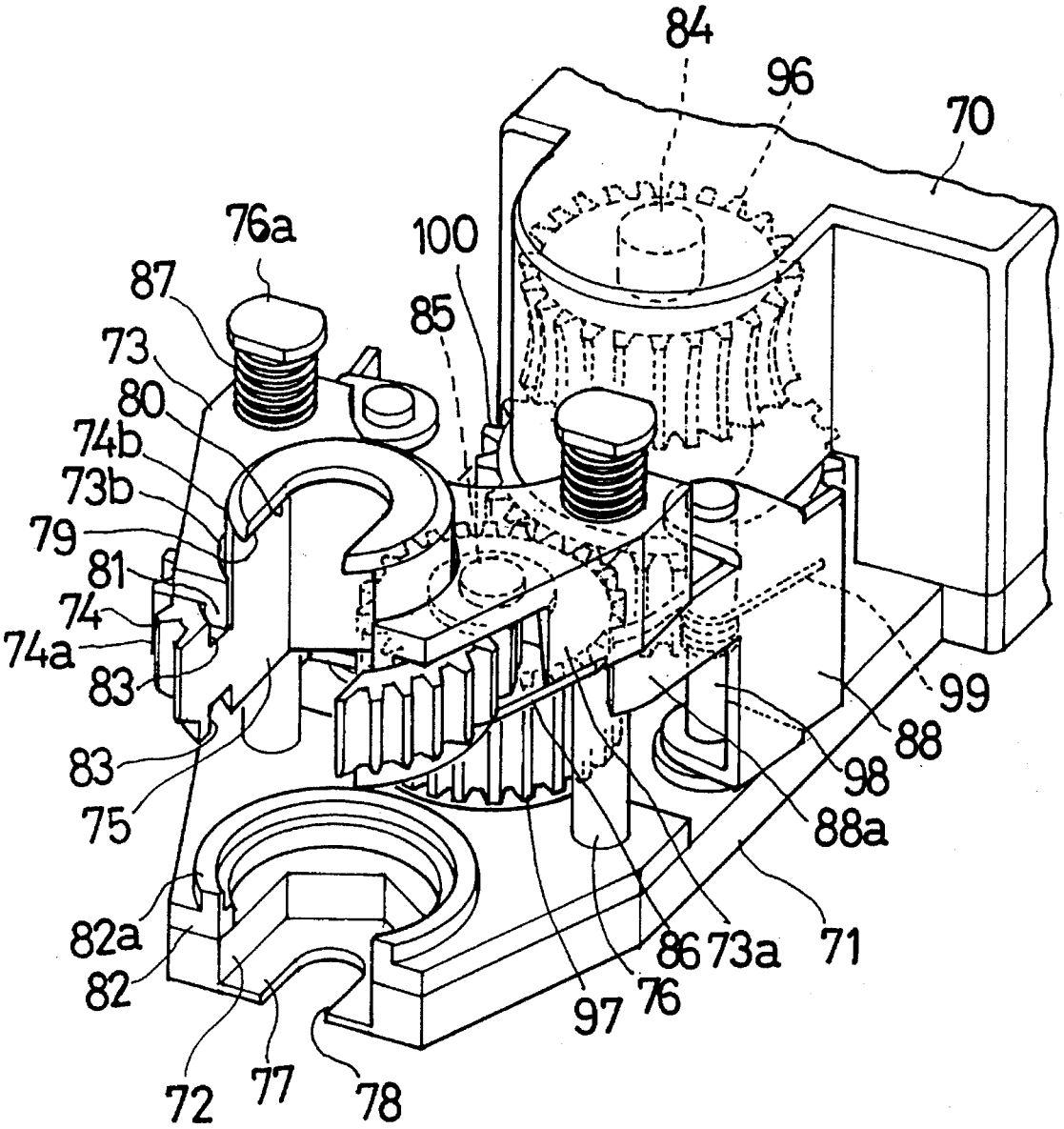
FIG. 16 is an exploded fragmentary perspective view of another electric motor-driven tightening device embodying the invention.
Figure 17:
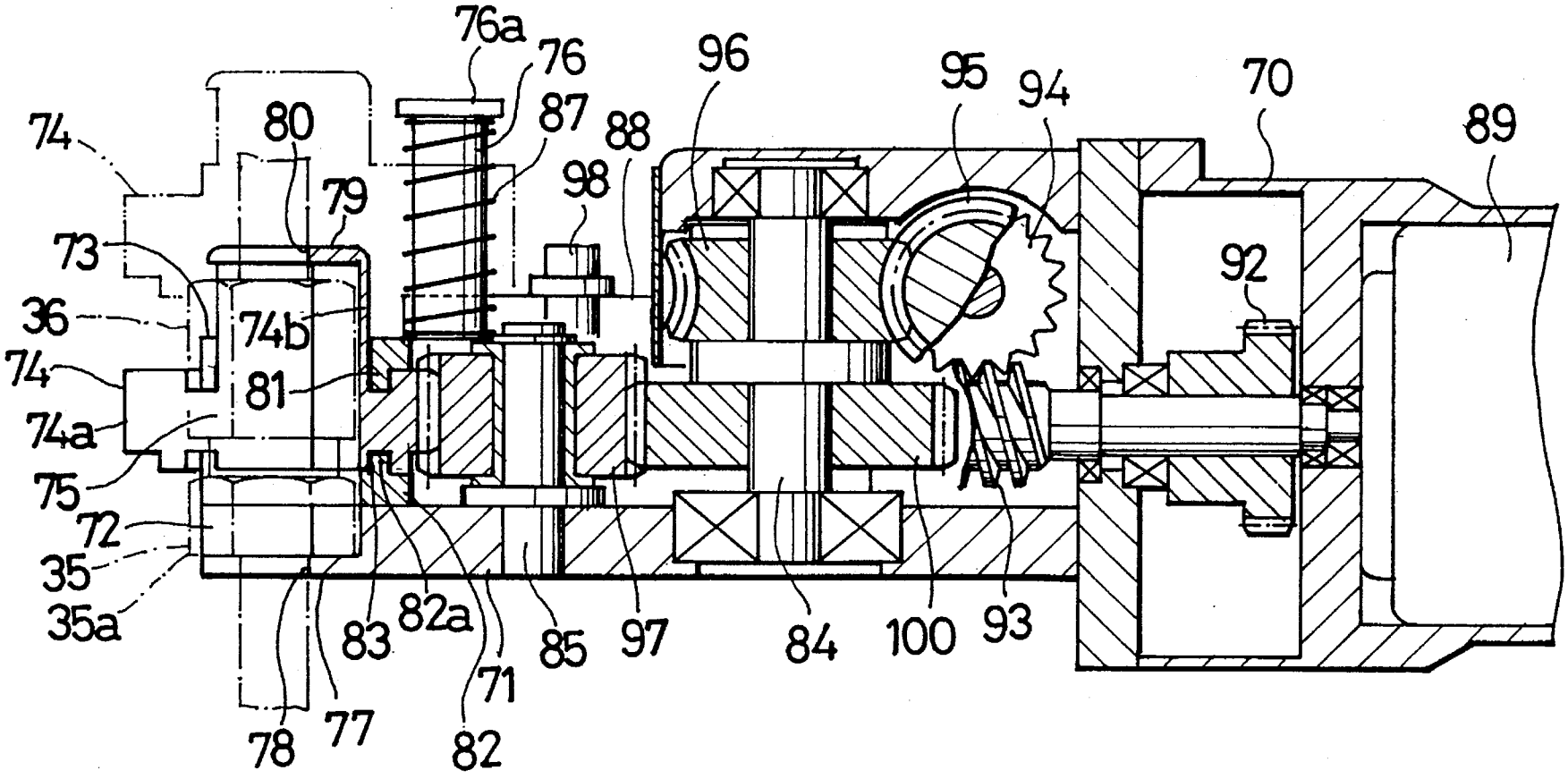
FIG. 17 is a view in vertical section of the same.
Figure 18:
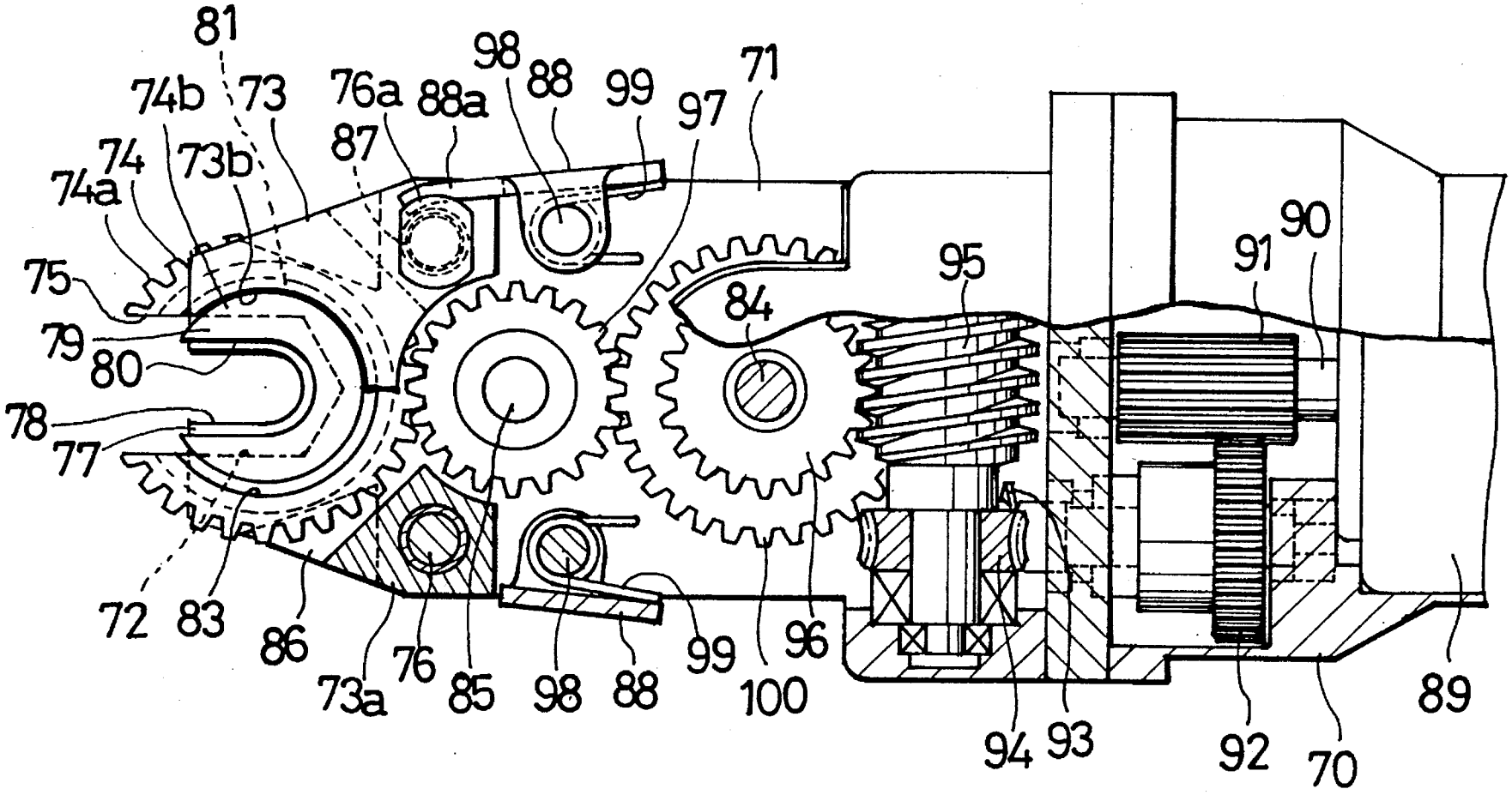
FIG. 18 is a plan view partly broken away and showing the same.
Figure 19:
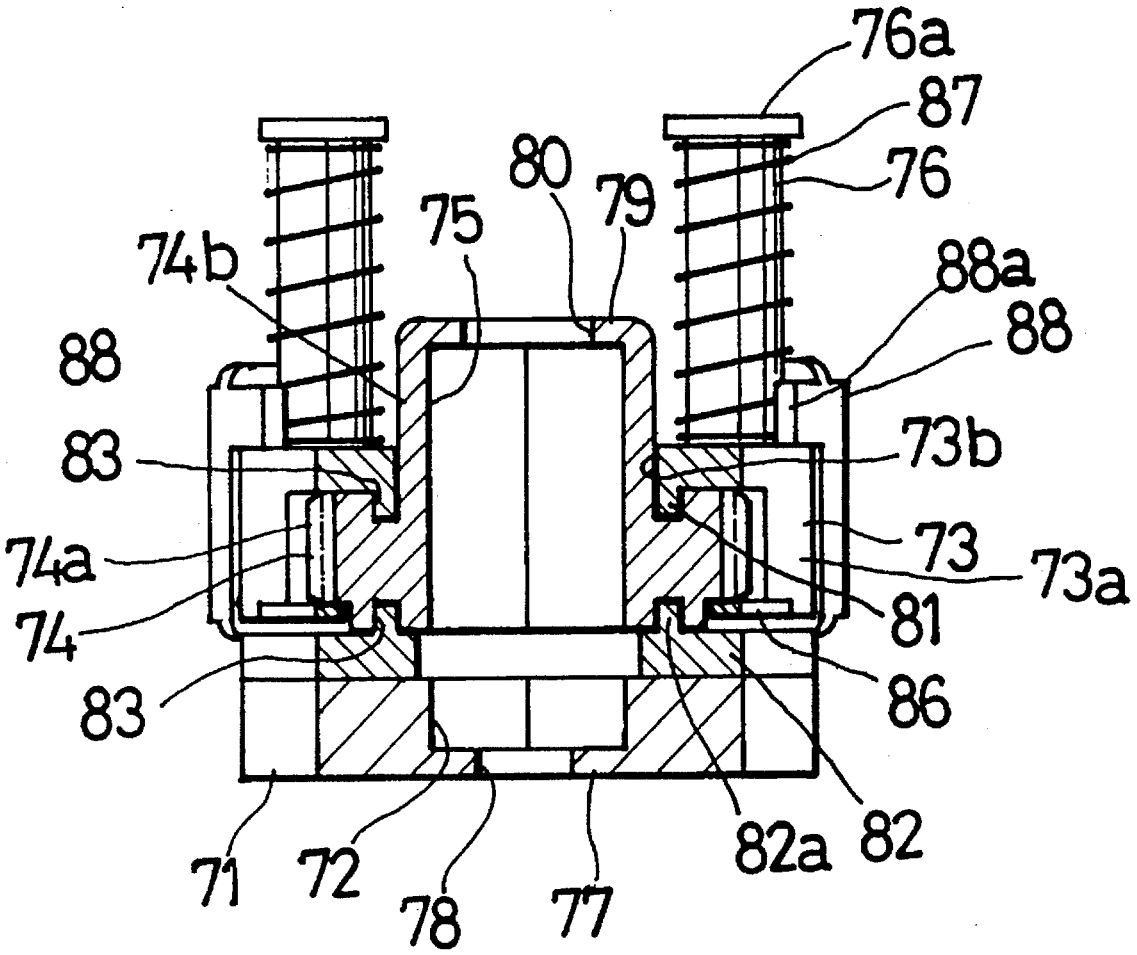
FIG. 19 is a view in cross section of the same.

FIGS. 13 to 15 show a manual tightening device. Throughout the drawings showing the motor-driven and manual tightening devices, like parts are designated by like reference numerals.

A spur gear 49 for driving a nut tightening gear 4 is coupled by a train of gears to a handle 57 having a horizontal rotary shaft 58. More specifically, a bevel gear 51 mounted on the shaft 58 of the handle 57 is in mesh with a bevel gear 52 having a vertical rotary shaft 59, which is provided with a spur gear 53. The gear 53 is in mesh with a rotation direction changing spur gear 54, which in turn meshes with a reduction spur gear 55 mounted on a vertical rotary shaft 60. A spur gear 56 on the shaft 60 meshes with the spur gear 49 for driving the nut tightening gear 4.

The spur gear 49 for driving the gear 4 has a vertical rotary shaft 61, which has attached to its upper end a rotary encoder 62 for detecting the angle of rotation of a nut 36. A tightening torque detecting strain gauge 63 is attached to the vertical rotary shaft 60 of the reduction spur gear 55.

A lever 43 for moving a lower plate 42 upward and downward is movably supported by a pivot 44 on each of opposite sides of a body 50. The lever 43 has a front end fixed by a pin 48 to an upright portion **42*a* of the lower plate 42. The lever 43 is formed with a slot 45 having the pivot 44 fitted therein. The body 50 has a guide pin 46 projecting from each side thereof and positioned closer to its base end than the pivot 44. Each lever 43 is formed with a guide groove 47 for moving the lower plate upward and downward in a horizontal position. When the lower plate 42 is moved upward or downward by the pivotal movement of each lever 43, the guide pin 46 is guided by the groove 47, permitting the pivot 44 to move within the slot 45, whereby the lower plate 42** is allowed to remain in the horizontal position during the movement.

The nut 36 is tightened up by the manual device generally in the same manner as when the motor-driven device is used. Although it is difficult to manually control the speed of rotation of the nut with the manual device, the rotation angle, if not controlled, results in no objection. Since the nut 36 can not be stopped automatically and is not rotated reversely automatically, the nut 36 is stopped when an indication of completion of acceptable tightening is given, and the tightening operation is discontinued and the nut 36 is manually rotated reversely when an alarm is given to indicate improper tightening.

Although the lower plates 3, 42 are made movable relative to the upper plates 1, 41 with the foregoing embodiments, they need not always be so movable. The gear 4 having the fitting portion and removably mountable may alternatively be fixed to the lower plate.

FIGS. 16 to 20 show another motor-driven tightening device embodying the present invention. The device comprises a lower plate 71 adapted to prevent an externally threaded member 35 from rotating and projecting forward from the front end of a body 70 housing a d.c. servomotor 89, a gear supporting upper plate 73 disposed above the lower plate 71 in parallel thereto and movable upward and downward, a nut rotating gear 74 mounted on the front end of the upper plate 73 and rotatable in a horizontal plane, and a drive spur gear 97 interposed between the lower plate 71 and the upper plate 73 and meshing with the gear 74 for rotating the gear.

The lower plate 71 is formed at its front end with a flange fitting portion 72 which is open toward the front. the flange fitting portion 72, which corresponds to the head of a spanner, has an opening width in conformity with the external size of a flange **35*a* of the externally threaded member 35. The threaded member 35 is prevented from rotation when the flange 35*a* thereof is fitted into the portion 72. The flange fitting portion 72 is formed at its bottom with a portion 77 in the form of a plate for the lower end of the flange 35*a* to bear on to prevent the threaded member from moving axially. The restraining portion 77 has a cutout 78 for a pipe or like member, connected to the threaded member 35**, to fit in.

The nut rotating gear 74 comprises a spur gear portion **74*a* having a nut fitting portion 75 for a nut 36 to fit in, and an upward extension 74*b* of the fitting portion 75. this portion 75 is open toward the front to removably fit the nut 36 thereinto and has an opening width in conformity with the external size of the nut 36. The extension 74*b* is in the form of a circular arc in cross section which arc is coaxial with the nut fitting portion. The extension 74*b* is formed at its upper end with a portion 79 in the form of a plate which comes into contact with the upper end of the nut 36 when the upper plate 73 is moved down to restrain the nut from moving axially. The restraining portion 79 has a cutout 80 for a pipe or the like to fit in as connected to the member 35. When the upper plate 73 is moved down, the distance between the restraining portions 77 and 79 is approximately equal to the distance from the lower end of the flange 35*a* to the upper end of the nut 36. When the nut is tightened, the threaded member 35 and the nut 36 are held at axially opposite sides by the two restraining portions 77, 79**. This ensures a facilitated tightening operation.

The front end of the upper plate is formed on its bottom side with a downward projection 81 in the form of a circular arc coaxial with the nut fitting portion 75. The lower plate 71 is provided on the upper side of its front end with a gear support plate 82 which has an upward projection **82*a* in the form of a circular arc coaxial with the flange fitting portion 72**.

The spur gear portion **74*a* of the gear 74 is formed in its upper and lower surfaces with upper and lower grooves 83 for the downward projection 81 of the upper plate 73 and the upward projection 82*a* of the gear support plate 82 to fit in, respectively. Although not shown, the lower ends of the teeth of the gear 74 and the upper ends of the teeth of the spur gear 97 meshing with the gear 74** are tapered so as to mesh with each other easily.

the upper plate 73 has at its rear end a pair of opposite downward projections **73*a*. A gear support plate 86 adapted to contact the gear 74 from therebelow is attached to the lower end of each downward projection 73*a*. The front end of the upper plate 73 has a cutout 73*b* for the extension 74*b* of the gear 74 to be inserted therethrough. The rear end of the upper plate 73 is cut out in a semicircular form so as not to interfere with the spur gear 97 meshing with the gear 74. When the upper plate 73 is in its upper position, the gear 74 is freely rotatable by being supported by the gear support plate 86 and being guided by the downward projection 81**.

The lower plate 71 is provided with a pair of opposite vertical guide rods 76, which connect the upper plate 73 to the lower plate 71 upwardly and downwardly movably. Each of the rods 76 extends through the upper plate 73 and has a spring retainer 76*a* at its upper end. A coiled compression spring 87 is held between the retainer 76*a* and the upper plate 73.

The lower plate 71 is provided with a pair of opposite vertical platelike stoppers 88 for stopping the upper plate 73 at its upper position where the gear 74 is out of meshing engagement with the spur gear 97. Each of the stoppers 88 is movably mounted on a vertical pivot 98 fixed to the lower plate 71, and has a front end providing an engaging pawl 88*a* which is in contact with the lower surface of the upper plate 73 at the position where the gear 74 is not in mesh with the spur gear 97. A coiled torsion spring 99 is fitted around the vertical pivot 98 and has one end fixed to the lower plate 71 and the other end bearing on the stopper 88. The engaging pawl 88*a* is pressed against the guide rod 76 by the force of the spring 99. When the rear ends of the stoppers 88 are pushed inward while the upper plate 73 is being held at rest in its upper position by the stoppers 88, the pawls 88*a* are moved away from each other, permitting the compression springs 87 to force the upper plate 73 downward to bring the gear 74 into meshing engagement with the spur gear 97, whereupon the pawls 88*a* are moved toward each other to be spaced apart by the original distance and come into contact with the upper surface of the upper plate 73. When the rear ends of the stoppers 88 are pushed inward in this state, the distance between the pawls 88*a* increases again. The upper plate 73 can then be moved upward manually against the force of the compression springs 87.

The spur gear 97 meshing with the nut rotating gear 74 is mounted on a vertical shaft 85 fixed to the lower plate 71 and is rotatable by the d.c. servomotor 89 through a train of gears. More specifically, the servomotor 89 has a drive shaft 90 which is rotatable clockwise when seen from the rear toward the front and which carries a spur gear 91. Meshing with this gear 91 is another spur gear 92 having a horizontal rotary shaft in parallel to the shaft 90. A worm 93 mounted on the shaft of the spur gear 92 is in mesh with a worm wheel 94 having a horizontal rotary shaft, which is provided with another worm 95. A worm wheel 96 meshing with the worm 95 is attached to a vertical rotary shaft 84. The gear 97 for transmission meshes with a spur gear 100 mounted on the vertical rotary shaft 84. As compared with the first embodiment, the transmission spur gear 97 is additionally provided as an idle gear between the nut rotating gear 74 and the spur gear 100 mounted on the shaft 84. Accordingly the lower plate 71 has an elongated flat lower surface.

With the device described, rotation time of the motor is used instead of measuring the rotation angle of the nut, and the current value of the motor 89 is used instead of measuring the tightening torque with a strain gauge. The judgment of proper tightening is made by checking whether the current value of the motor 89 upon lapse of a specified period of time is within a specified range. This is based on the finding that the torque curve and the curve of motor current values extend similarly with respect to the time axis, consequently eliminating the need to use the rotary plate 16, rotation angle sensor 17, strain gauge 18 and tightening torque sensor 28 included in the first embodiment. Thus, the present device is simple in construction.

The device is used in the following manner for tightening the nut 36 as manually tightened on the externally threaded member 35.

Figure 20B:
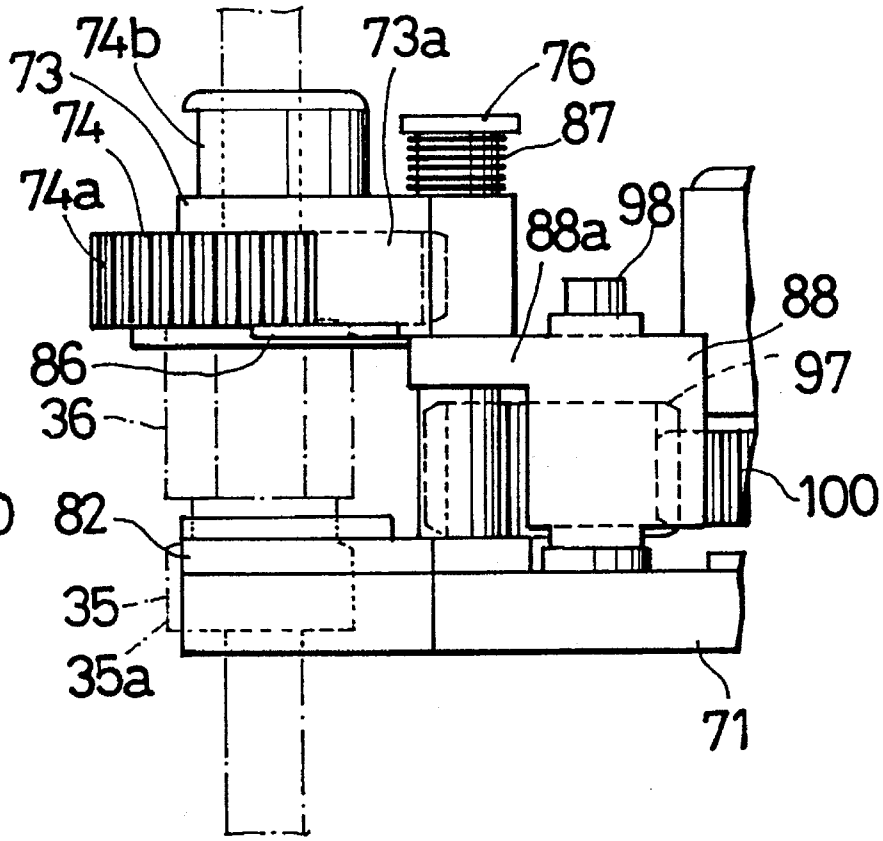
FIG. 20 is a side elevation showing the movement of an upper plate.
Figure 20A:
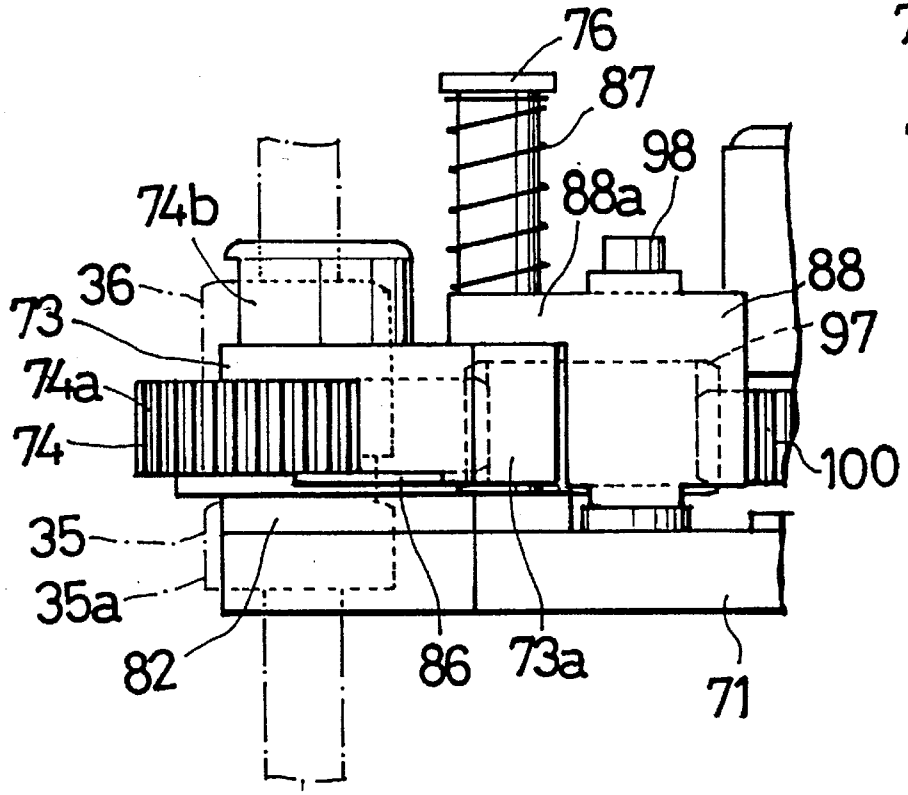

First, the upper plate 73 is brought to its upper position in which the gear 74 is not in mesh with the spur gear 97 (see FIG. 20, (*b*)). More specifically, the rear ends of the stoppers 88 are pushed inward with one hand holding the body 70 to move the engaging pawls 88*a* of the stoppers 88 away from each other, and the upper plate 73 is pulled up with the other hand. When released from the hand, the stoppers 88 are closed by the force of the springs 99, and the upper plate 73 is held in the upper position by the stoppers 88. Next, the flange fitting portion 72 of the lower plate 71 is fitted to the flange 35*a* of the externally threaded member 35. The nut fitting portion 75 is thereafter fitted to the nut 36 while manually rotating the gear 74, and the stoppers 88 are forced open with fingers, whereupon the upper plate 73 is moved down by the force of the compression springs 87, bringing the gear 74 into meshing engagement with the drive spur gear 97, with the upward projection 82*a* of the gear support plate 82 fitting in the groove 83 in the lower surface of the gear 74 (see FIG. 20 (*a*). The start button is now pressed. The nut 36 is then automatically tightened up, and whether the nut is normally tightened is judged to complete the tightening operation.

What is claimed is:

1. A device for tightening up a nut screwed on an externally threaded member having a flange, the device comprising:

a body, a preventing member for preventing rotation of the externally threaded member, the preventing member projecting forward from a front end of the body and having a flange fitting portion open in a predetermined direction, a gear support member attached to the preventing member and having a gear support portion coaxial with the flange fitting portion, a nut rotating gear having a nut fitting portion coaxial with and open generally in the same direction as the flange fitting portion, the nut rotating gear being supported by the gear support member so as to be rotatable about a longitudinal axis of the nut fitting portion, a transmission gear attached to the preventing member and meshable with the nut rotating gear to rotate the gear, and means for driving the transmission gear, wherein said gear support member is movable in the longitudinal direction to and from said body between a position adjacent said body where the nut rotating gear meshes with the transmission gear and a position distal from said body where the rotating gear is out of mesh with the transmission gear;

wherein the gear support member is movable between said adjacent position where the nut rotating gear meshes with the transmission gear and said distal position where the gears are out of meshing engagement with each other via a guide means provided on one of said body and said gear support member and extending in said longitudinal direction, said guide means penetrating through respective openings in the other of said body and said gear support member.

2. A device as defined in claim 1, wherein the nut rotating gear is formed in each of its opposite side faces with a circular-arc groove centered about the axis of the nut fitting portion, and each of the gear support member and the preventing member is formed with a circular-arc projection fittable in the groove for guiding the rotating gear.

3. A device as defined in claim 1 wherein the flange fitting portion is provided with a portion for restraining the threaded member from moving axially, the nut fitting portion being provided with a portion for restraining the nut from moving axially, the threaded member and the nut being holdable on axially opposite sides thereof by the two restraining portions when the nut rotating gear is meshed with the transmission gear.

4. A device as defined in claim 1, wherein said plurality of guide rods each have a member thereon for preventing said body and said gear support member from being fully separated and for maintaining said body and said support member in said distal position.

5. A device as defined in claim 4, wherein said member is a block at the end of the respective rod.

6. A device as defined in claim 4, wherein said member is a spring retainer at the end of the respective rod.

7. A device as defined in claim 1, wherein the driving means comprises a motor housed in the body, and a train of gears for transmitting rotation from a drive shaft of the motor to the transmission gear.

8. A device as defined in claim 1 further comprising means for detecting the amount of tightening of the nut.

9. a device as defined in claim 1 further comprising means for detecting tightening torque.

10. A device as defined in claim 1 further comprising means for detecting the amount of tightening of the nut, means for detecting tightening torque and means for judging whether the nut is tightened normally from the amount of tightening and tightening torque detected.

11. A device as defined in claim 1, further including a biasing means which urges said gear support member towards said adjacent position and at least one stopper member for maintaining said gear support member in said distal position.

12. A device as defined in claim 11, wherein said stopper member is provided with an engaging pawl that is capable of being moved to a holding position between said gear support member and said body to prevent relative movement therebetween.

13. A device as defined in claim 11, wherein said stopper member is provided with an engaging pawl that is pivotable around an axis extending in said longitudinal direction and is urged toward said holding position by a spring.

14. A device as defined in claim 13, wherein the gear support member is movable between said adjacent position where the nut rotating gear meshes with the transmission gear and said distal position where the gears are out of meshing engagement with each other via a plurality of guide rods provided on one of said body and said gear support member and extending in said longitudinal direction, said guide rods penetrating through respective openings in the other of said body and said gear support member, and said engaging pawl urged against one of said guide rods by said spring.

15. A device for tightening up a nut screwed on an externally threaded member having a flange, the device comprising:

a body, a preventing member for preventing rotation of the externally threaded member, the preventing member projecting forward from a front end of the body and having a flange fitting portion open in a predetermined direction, a gear support member attached to the preventing member and having a gear support portion coaxial with the flange fitting portion, a nut rotating gear having a nut fitting portion coaxial with and open generally in the same direction as the flange fitting portion, the nut rotating gear being supported by the gear support member so as to be rotatable about a longitudinal axis of the nut fitting portion, a transmission gear attached to the preventing member and meshable with the nut rotating gear to rotate the gear, means for driving the transmission gear, wherein the gear support member is movable between a position where the nut rotating gear meshes with the transmission gear and a position where the gears are out of meshing engagement with each other, and wherein a pair of guide rods slidably extends through the preventing member, and the gear support member is fixed to one end of each of the guide rods, an eccentric roller being provided between and attached to the other ends of the guide rods, the gear support member being movable by rotating the eccentric roller.

16. A device for tightening up a nut screwed on an externally threaded member having a flange, the device comprising:

a body, a preventing member for preventing rotation of the externally threaded member, the preventing member projecting forward from a front end of the body and having a flange fitting portion open in a predetermined direction, a gear support member attached to the preventing member and having a gear support portion coaxial with the flange fitting portion, a nut rotating gear having a nut fitting portion coaxial with and open generally in the same direction as the flange fitting portion, the nut rotating gear being supported by the gear support member so as to be rotatable about a longitudinal axis of the nut fitting portion, a transmission gear attached to the preventing member and meshable with the nut rotating gear to rotate the gear, means for driving the transmission gear, wherein the gear support member is movable between a position where the nut rotating gear meshes with the transmission gear and a position where the gears are out of meshing engagement with each other, and wherein the preventing member has fixed thereto one end of each of a pair of guide rods, and a gear support member is slidably attached to the guide rods, a coiled spring being fitted around the other end of each guide rod for biasing the gear support member toward the preventing member.

17. A device as defined in claim 16 wherein the preventing member is provided with stoppers for stopping the gear support member at the position where the gears are out of meshing engagement with each other.

18. A device for tightening up a nut screwed on an externally threaded member having a flange, the device comprising:

a body, a preventing member for preventing rotation of the externally threaded member, the preventing member projecting forward from a front end of the body and having a flange fitting portion open in a predetermined direction, a gear support member attached to the preventing member and having a gear support portion coaxial with the flange fitting portion, a nut rotating gear having a nut fitting portion coaxial with and open generally in the same direction as the flange fitting portion, the nut rotating gear being supported by the gear support member so as to be rotatable about a longitudinal axis of the nut fitting portion, a transmission gear attached to the preventing member and meshable with the nut rotating gear to rotate the gear, and means for driving the transmission gear, wherein said gear support member is movable in the longitudinal direction to and from said body between a position adjacent said body where the nut rotating gear meshes with the transmission gear and a position distal from said body where the rotating gear is out of mesh with the transmission gear, wherein a lift lever is pivoted to the preventing member around a pivot axis substantially perpendicular to said longitudinal direction and has one end fixed to the gear support member, the gear support member being movable in the longitudinal direction by pivotally moving the lift lever.

* * * * *